US008876034B2

(12) United States Patent
Kawashima et al.

(10) Patent No.: US 8,876,034 B2
(45) Date of Patent: Nov. 4, 2014

(54) SHEET STORAGE CASSETTE AND PRINTING APPARATUS

(75) Inventors: Hideki Kawashima, Kawasaki (JP); Ryoji Okuno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 555 days.

(21) Appl. No.: 13/178,705

(22) Filed: Jul. 8, 2011

(65) Prior Publication Data

US 2012/0027494 A1 Feb. 2, 2012

(30) Foreign Application Priority Data

Jul. 30, 2010 (JP) ..... 2010-172782

(51) Int. Cl.
*B65H 75/24* (2006.01)
*B41J 15/04* (2006.01)

(52) U.S. Cl.
CPC ..... *B41J 15/044* (2013.01); *B65H 75/245* (2013.01)
USPC ..... 242/571; 242/571.4; 242/571.5; 242/571.8

(58) Field of Classification Search
USPC ..... 242/571, 571.3–571.5, 571.8
See application file for complete search history.

(56) References Cited

U.S. PATENT DOCUMENTS

| | | | | |
|---|---|---|---|---|
| 2,198,421 | A * | 4/1940 | Wise | 242/571.3 |
| 5,433,393 | A | 7/1995 | Nishitani | |
| 5,927,876 | A | 7/1999 | Fox | |
| 6,315,235 | B1 * | 11/2001 | Breyer et al. | 242/422.4 |
| 6,357,687 | B1 * | 3/2002 | Liu | 242/422.4 |
| 2009/0272838 | A1 | 11/2009 | Kaminaka | |

FOREIGN PATENT DOCUMENTS

| | | | |
|---|---|---|---|
| CN | 1132716 | A | 10/1996 |
| CN | 1572516 | A | 2/2005 |
| EP | 0955173 | A | 11/1999 |
| JP | 10-291706 | A | 11/1998 |
| JP | 2002-308482 | A | 10/2002 |
| JP | 2002-326742 | | 11/2002 |
| JP | 2005-262491 | A | 9/2005 |
| JP | 2005-349744 | A | 12/2005 |
| JP | 2006-168974 | A | 6/2006 |
| JP | 2006-306511 | | 11/2006 |

(Continued)

OTHER PUBLICATIONS

He above references were cited in a Sep. 2, 2013 Chinese Office Action, which is enclosed with English Translation, that issued in Chinese Patent Application No. 201110216899.7.

(Continued)

*Primary Examiner* — Sang Kim
(74) *Attorney, Agent, or Firm* — Cowan, Liebowitz & Latman, P.C.

(57) ABSTRACT

A sheet storage cassette which contains a print sheet in roll form and is attached to a printing apparatus, comprises: a shaft which retaining the print sheet in roll form; and a support portion rotatably supporting the shaft, wherein an urging member protrudes from a maximum outer diameter of the shaft while the print sheet is not attached to the shaft, and urges the inner surface of a hollow portion of the print sheet while the print sheet is attached to the shaft, and a rib portion which continuously extends in a rotational direction and contacts a pickup guide, when the urging member rotates, the rib portion is provided to prevent the pickup guide from interfering with the urging member which rotates together with the shaft.

10 Claims, 19 Drawing Sheets

(56) References Cited

FOREIGN PATENT DOCUMENTS

| | | |
|---|---|---|
| JP | 3861727 | 12/2006 |
| JP | 2008-100369 | 5/2008 |
| JP | 2009-143021 A | 7/2009 |

OTHER PUBLICATIONS

The above foreign patent documents were cited in the Apr. 11, 2014 Japanese Office Action, which is enclosed without an English Translation, that issued in Japanese Patent Application No. 2010-172782.

* cited by examiner

SHEET STORAGE CASSETTE AND PRINTING APPARATUS

BACKGROUND OF THE INVENTION

1. Field of the Invention

The present invention relates to a sheet storage cassette and a printing apparatus.

2. Description of the Related Art

Conventionally, printers using roll paper have been widely used as business printers, and some home printers are compatible with roll paper. An advantage of the use of roll paper is that since it is possible to continuously feed paper, when continuous printing is to be performed, it is possible to complete paper feeding operation in a relatively short period of time as compared with feeding of rectangular sheets cut to a predetermined size in advance. For this reason, when continuously printing in large quantities, roll paper is more suitable for high-speed printing. Another advantage of the use of roll paper, other than high-speed printing, is that no marginal portions remain on printed matter.

The reason why marginal portions are required when using rectangular sheets will now be described. A sublimation printer heats sublimation ink to transfer it onto a sheet with the sheet being pressed against an ink ribbon. This leads to large conveyance resistance at the printing unit, resulting in an increase in the load of conveying the sheet at the time of printing. In addition, when printing a color image, the printer reciprocally conveys a sheet to superimpose yellow, magenta, and cyan inks. For this reason, if the amount of sheet feed decreases due to the conveyance load at the time of printing, color misregistration occurs and causes a deterioration in print quality.

In order to maintain print quality, it is necessary to convey paper at the time of printing while reliably gripping the paper with convey rollers from the start of conveyance to the end of conveyance. An unprintable portion always appears in the distance from the thermal head to the convey rollers at the start of printing, and hence the unprintable portion becomes a marginal portion. To handle such a marginal portion, a perforated line is provided to cut off the marginal portion. In addition, as disclosed in Japanese Patent Laid-Open No. 2008-100369, a marginal portion is used as a leg portion to stand paper like a photograph stand. However, a roll paper system free of the trouble of having to cut off marginal portions is more preferable than this method.

Digital cameras have been become popular in recent years. To allow more users to print many photographic data captured by these cameras, it is important to shorten the printing time and save the trouble of cutting off the marginal portions of printed matter. In addition, specifications designed to implement high-speed printing without any marginal portions are required for not only business printers but also home printers.

Another merit of roll paper in terms of the cost per print is that it is easier to achieve low cost in manufacturing roll paper than in manufacturing rectangular sheets with perforated lines. In addition, with regard to the form of supplying consumable materials to users, allowing users to refill only paper wound in roll form can minimize the cost of paper as a consumable material.

As described above, a printer of the roll paper system is required to achieve low-cost and high-speed performance, and the lowest cost usage of roll paper itself is to allow the user place the roll paper which he/she purchased into a roll paper storage cassette, with the shaft being inserted through the roll paper, and load the cassette in the printer main body.

A conventional sublimation printer using rectangular sheets can handle different kinds of sheets, and allows sheets and an ink ribbon to be replaced even when they are not used up. When using the roll paper system, therefore, it is necessary for the printer to be compatible with different paper sizes and allow paper to be replaced even before it is used up.

Consider the roll paper storage cassette disclosed in Japanese Patent Laid-Open No. 2006-306511. With this cassette, when the user removes roll paper before it is used up to replace it, the roll paper unrolls. The user must therefore wind the roll paper again and load it in the roll paper storage cassette.

Roll paper is generally wound with the printing surface being the inner surface, and hence the user does not touch the printing surface. However, when the roll paper unrolls, the user may touch the printing surface. At a portion of the printing surface which the user has touched, sublimated ink becomes difficult to adhere. This may lead to a deterioration in print quality.

For this reason, when using a home printer, it is preferable not to open the roll paper storage cassette until the roll paper is used up once it is loaded in the roll paper storage cassette. In addition, preparing roll paper storage cassettes corresponding to the types of roll paper to be used makes it possible to store the roll paper without contaminating it, prevent errors in detecting the cassette type, and replace it simply by replacing the cassette alone.

In addition, home printers need to be more compact with higher usability. In order to reduce the size of a printer, therefore, it is necessary to reduce the size of roll paper storage cassettes themselves and improve the layout of the paper storage cassette, ink ribbon cassette, cutter unit, and the like so as to reduce the size of the printer main body.

FIGS. 10A and 10B are schematic views each exemplifying a layout for making a printer compact. FIG. 10A shows a standby state. FIG. 10B shows a paper-feeding state. Reference numeral 901 denotes a roll paper storage cassette; 902, an ink ribbon cassette; 903, a feed roller; 904, a grip roller pair; 905, a thermal head; 906, a platen roller; and 907, a cutter.

In the standby state shown in FIG. 10A, the feed roller 903 is at a retreat position, and the roll paper storage cassette 901 is attached to the main body. The roll paper storage cassette 901 is loaded/unloaded in/from the printer main body by being slid in the direction of a roll paper shaft 908 to reduce the opening portion of the printer main body and allow the roll paper storage cassette 901 to be loaded in the main body in the same direction as that in which the ink ribbon cassette 902 is loaded/unloaded. For this purpose, the retreat position of the feed roller 903 must be a position where the roller does not collide with the roll paper storage cassette 901. As shown in FIG. 10A, since a frame 910 of the printer main body or its exterior is located below the feed roller 903 at the retreat position, the rubber diameter of the feed roller 903 is preferably minimized to reduce the size of the printer main body.

At the time of paper feeding shown in FIG. 10B, the feed roller 903 provided in the printer main body moves upward to apply a driving force to the outer surface of roll paper 909 to rotate it in a direction to pick up the leading end of the roll paper from the roll paper storage cassette 901. There are tendencies that as a paper convey path bends, the conveyance load increases, and that as the diameter of the feed roller 903 decreases, the conveying force decreases. For this reason, it is preferable to reduce resistance against the rotation of roll paper. It is especially necessary to make the roll paper shaft 908 smoothly rotate.

With regard to usability, when the user inserts roll paper into the roll paper shaft and loads it into the roll paper storage cassette 901, the roll paper shaft tends to slip off the roll paper. This makes it difficult to insert the roll paper into the roll paper storage cassette 901. This is because the surface of the roll paper shaft described above is made slippery, and there is always a gap between the roll paper shaft and the inner diameter portion of roll paper because the inner diameter tends to vary depending on the roll paper.

There are available methods for positioning a roll paper shaft and roll paper by using a paper tube for the inner diameter of the roll paper and for stopping rotation and supporting a shaft with a complicated mechanism, as disclosed in Japanese Patent Laid-Open No. 2002-326742. In order to implement a simple, low-cost arrangement, however, a method of integrally forming resin springs with a roll paper shaft as a resin component is optimal.

FIG. 11 is a perspective view of an arrangement in which resin springs 908*a* are integrally provided with the roll paper shaft 908. The resin springs 908*a* are provided for the roll paper shaft 908 by using a thinning portion formed near the middle portion. A portion of each resin spring 908*a* which the inner diameter portion of the roll paper 909 contacts has a round shape to prevent it from being caught on the inner diameter portion at the time of loading and at the time of rotation. Although one resin spring is enough to obtain some effect, a pair of resin springs are provided to achieve a balance. When the user inserts the roll paper shaft 908 into the roll paper 909, the pair of resin springs 908*a* are charged to increase friction to make the roll paper shaft 908 difficult to slip on the roll paper 909.

FIGS. 12A and 12B are sectional views showing the deformation of the resin springs 908*a* when the roll paper shaft 908 is inserted into the roll paper 909. FIG. 12A shows the resin springs 908*a* before deformation. FIG. 12B shows the resin springs 908*a* after deformation. A thinning portion 908*b* serves as a retreat space for the resin springs 908*a*. Even when the roll paper shaft 908 is pressed after insertion into the roll paper 909, apexes 908*c* of the resin springs 908*a* are located completely inside the outer diameter of the roll paper shaft 908. It is possible to improve usability so as to prevent the resin springs 908*a* from generating resistance against the conveyance of paper by setting the deformation load of the resin springs 908*a* to a degree that prevents the roll paper shaft 908 supporting the roll paper 909 from slipping down under its own weight.

However, since the urging force of the resin spring 908*a* against the inner diameter portion of roll paper is minimized, a reduction in the strength of the resin spring 908*a* of the roll paper shaft 908 may cause the user to deform the resin spring 908*a*. If the user greatly deforms the resin spring in its opening direction, the resin spring plastically deforms. As a result, the resin spring is caught on the roll paper at the time of loading. In addition, if the user forcibly inserts the resin spring, deformed in its opening direction, into the inner diameter portion of roll paper, the charged amounts of the resin springs increase to greatly urge the resin springs. This may depress the paper at a position near the inner diameter portion of the roll paper. In addition, the resin springs may be caught on the inner diameter portion of the roll paper when the roll paper rotates during printing. This may make it difficult for the roll paper shaft to smoothly rotate, resulting in affecting the printing operation.

In addition, since the resin springs are provided on the roll paper shaft, the resin springs may collide with a guide member which picks up the leading end of roll paper. The distal end of the pickup guide preferably extends near the roll paper shaft so as to pick up roll paper to the end even if the winding diameter decreases as the printing operation proceeds. As a consequence, the distance between the maximum outer diameter surface of the roll paper shaft and the pickup guide decreases. The resin springs of the roll paper shaft without roll paper being loaded are in an open state. In this state, the resin springs easily make contact with the distal end of the pickup guide. It is assumed that when roll paper is used up or only the roll paper shaft 908 is loaded in the roll paper storage cassette 901, the resin springs spread open. If it is possible to detect the presence/absence of paper, it is possible to prevent the roll paper shaft 908 from rotating. However, since the roll paper storage portion has no detection means, the point at which the presence/absence of paper can be determined is the time when the leading end of paper is detected at the time of paper feeding. The roll paper shaft 908 therefore rotates until this timing.

FIGS. 13A to 13C are sectional views showing the relationship between the resin springs 908*a* and a pickup guide 911 when loading only the roll paper shaft 908 in the roll paper storage cassette 901, and performing paper feeding operation using the feed roller 903. The pickup guide 911 is a component for picking up the leading end of roll paper on the outermost circumference of the roll paper at the time of paper feeding, and is urged clockwise in FIG. 13A to make contact with the roll paper. FIG. 13A shows a state in which rotation starts, and the resin springs 908*a* protrude from an outer diameter 908*d* of the roll paper shaft. At the time of paper feeding, as indicated by the arrow, the feed roller 903 rotates clockwise. When the feed roller 903 rotates to the position in FIG. 13B, the resin spring 908*a* contacts the bottom surface of the roll paper storage cassette 901. However, since the resin spring 908*a* deforms, the feed roller 903 can rotate without being caught. When the feed roller 903 rotates to the position in FIG. 13C, however, a pickup guide distal end 911*a* collides with a side surface of the resin spring 908*a*, or the pickup guide distal end slides under the resin spring 908*a*. This may damage the resin spring 908*a* or the pickup guide 911.

SUMMARY OF THE INVENTION

The present invention has been made in consideration of the aforementioned problems, and realizes a sheet storage cassette which does not damage the spring members provided on the shaft which retains roll paper and pickup guide even when no roll paper is loaded, and a printing apparatus.

In order to solve the aforementioned problems, the present invention provides a sheet storage cassette which contains a print sheet in roll form wound into a hollow cylindrical shape and is attached to a printing apparatus, the cassette comprising: a sheet retaining shaft which retains the print sheet in roll form by being made to extend through a hollow portion of the print sheet and making an urging member urge an inner surface of the hollow portion in a diameter expanding direction; and a support portion which rotatably supports the sheet retaining shaft, wherein the urging member protrudes from a maximum outer diameter of the sheet retaining shaft while the print sheet is not attached to the sheet retaining shaft, and urges the inner surface of the hollow portion of the print sheet in the diameter expanding direction while the print sheet is attached to the sheet retaining shaft, and a rib portion which is provided at the sheet retaining shaft and continuously extends in a rotational direction and contacts a pickup guide, which picks up a leading end of a print sheet which is rotated by a roller of the printing apparatus, when the urging member rotates, wherein the rib portion is provided to prevent the pickup guide from interfering with the urging member which rotates together with the sheet retaining shaft.

In order to solve the aforementioned problems, the present invention provides a sheet storage cassette which contains a print sheet in roll form wound into a hollow cylindrical shape and is attached to a printing apparatus, the cassette comprising: a sheet retaining shaft which retains the print sheet in roll form by being made to extend through a hollow portion of the print sheet and making an urging member urge an inner surface of the hollow portion in a diameter expanding direction; and a support portion which rotatably supports the sheet retaining shaft, wherein the urging member protrudes from a maximum outer diameter of the sheet retaining shaft while the print sheet is not attached to the sheet retaining shaft, and urges the inner surface of the hollow portion of the print sheet in the diameter expanding direction while the print sheet is attached to the sheet retaining shaft, and a restriction member which restricts a deformation amount of the urging member when the urging member is urged in the diameter expanding direction is provided.

In order to solve the aforementioned problems, the present invention provides a sheet storage cassette which contains a print sheet in roll form wound into a hollow cylindrical shape and is attached to a printing apparatus, the cassette comprising: a sheet retaining shaft which retains the print sheet in roll form by being made to extend through a hollow portion of the print sheet and making an urging member urge an inner surface of the hollow portion in a diameter expanding direction; and a support portion which rotatably supports the sheet retaining shaft, wherein the urging member protrudes from a maximum outer diameter of the sheet retaining shaft while the print sheet is not attached to the sheet retaining shaft, and urges the inner surface of the hollow portion of the print sheet in the diameter expanding direction by being urged while the print sheet is attached to the sheet retaining shaft, an end detection mark in a hole shape or a concave/convex shape configured to detect an end of the print sheet is provided on part of a surface of the print sheet, and the end detection mark is provided in a portion of the print sheet other than an area opposite to a cylindrical portion of the sheet retaining shaft.

In order to solve the aforementioned problems, the present invention provides a printing apparatus which performs printing by transferring ink onto a print sheet using a thermal head, the apparatus comprising: a sheet storage cassette defined above; and convey means for conveying a print sheet from the sheet storage cassette to the thermal head.

According to the present invention, it is possible to implement a structure which does not damage the spring members provided on the shaft which retains roll paper and pickup guide even when no roll paper is loaded.

Further features and aspects of the present invention will become apparent from the following detailed description of exemplary embodiments with reference to the attached drawings.

DESCRIPTION OF THE EMBODIMENTS

Embodiments of the present invention will be described in detail below with reference to the accompanying drawings. The following embodiments are merely examples for practicing the present invention. The embodiments should be properly modified or changed depending on various conditions and the structure of an apparatus to which the present invention is applied. The present invention should not be limited to the following embodiments. Parts of the respective embodiments to be described later may be properly combined.

First Embodiment

Figure 1:
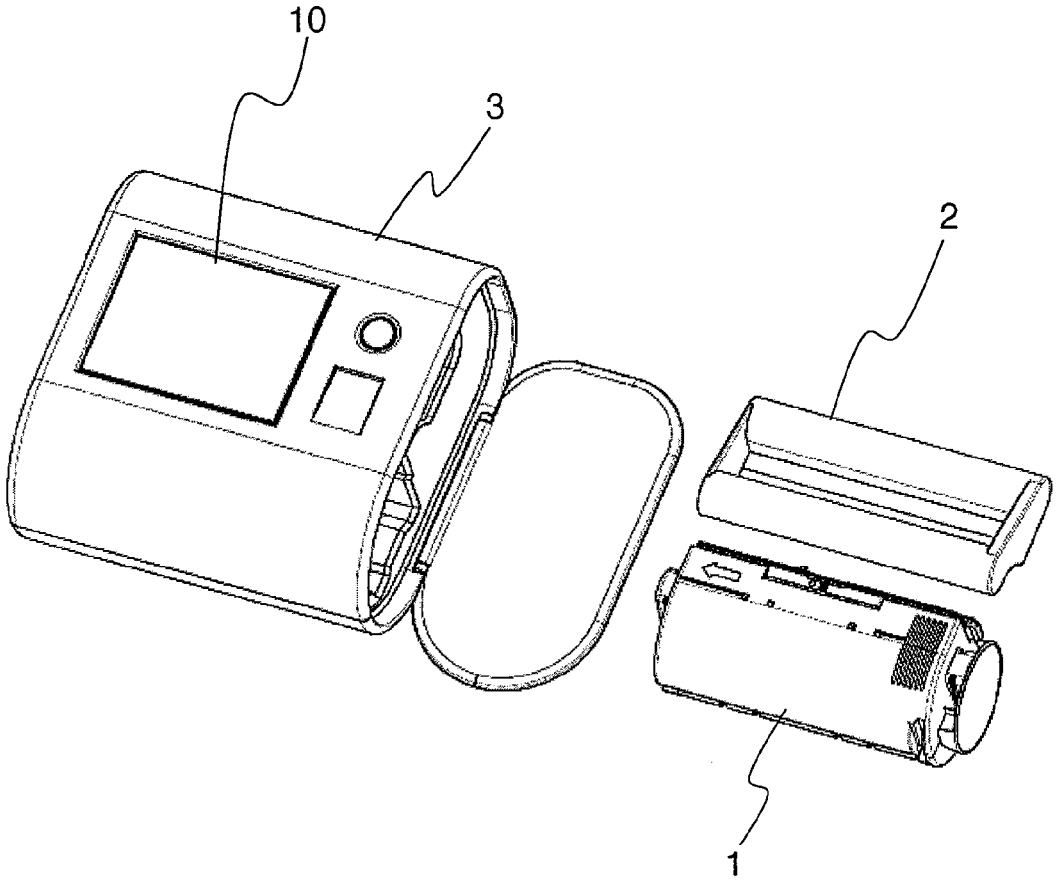
FIG. 1 is a perspective view showing the arrangement of a printer and cassette according to the first embodiment.

FIG. 1 shows a sheet storage cassette 1 for containing a print sheet in roll form, an ink ribbon cassette 2, and a printing apparatus (to be referred to as a printer hereinafter) 3, to which they can be attached, in this embodiment. The print sheet in roll form (to be referred to as roll paper hereinafter) is wound in hollow cylindrical form. When performing printing, the user loads the sheet storage cassette 1 for containing and retaining the ink ribbon cassette 2 and roll paper R into the printer main body 3, and then starts printing upon selecting an image with an operation unit 10 such as a touch panel of the printer main body 3.

The ink ribbon cassette 2 mainly includes an ink ribbon carrying ink, a take-up bobbin which takes up the ink ribbon, and a case which retains them. They are completely assembled together at the time of sale. After the ink ribbon is used up, the ribbon is discarded and recovered in the form of the ink ribbon cassette 2.

The manner of opening the roll paper storage cassette 1 will now be described with reference to FIGS. 2A and 2B. An open lever 103 is mounted on upper case 101 of the roll paper storage cassette, and a slide member 104 is mounted on a lower case 102. A lock mechanism for keeping the upper case 101 and the lower case 102 closed is configured such that a projection provided on the open lever 103 is fitted in a predetermined hole in the lower case 102 to lock the cases. When opening the upper case 101, the user can release the lock by pushing a finger engaging portion 103*a* of the open lever 103.

Figure 2A:
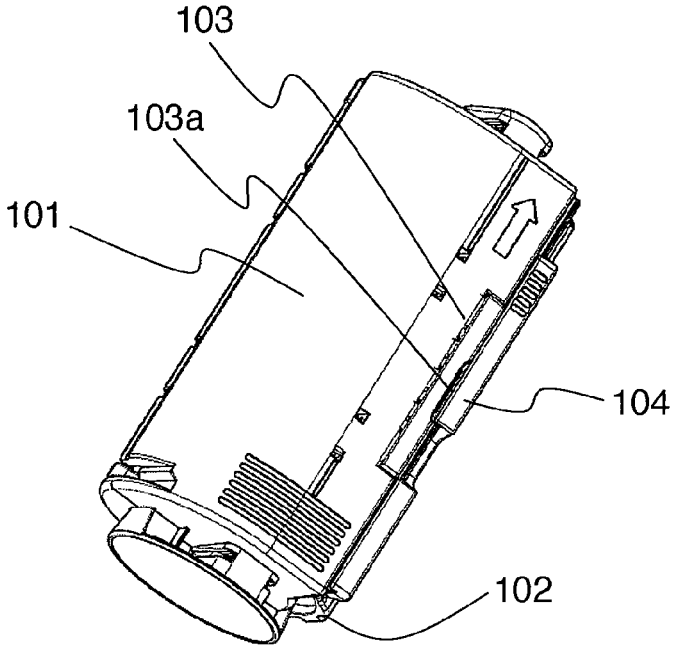
FIGS. 2A and 2B are perspective views of a roll paper storage cassette according to the first embodiment.
Figure 2B:
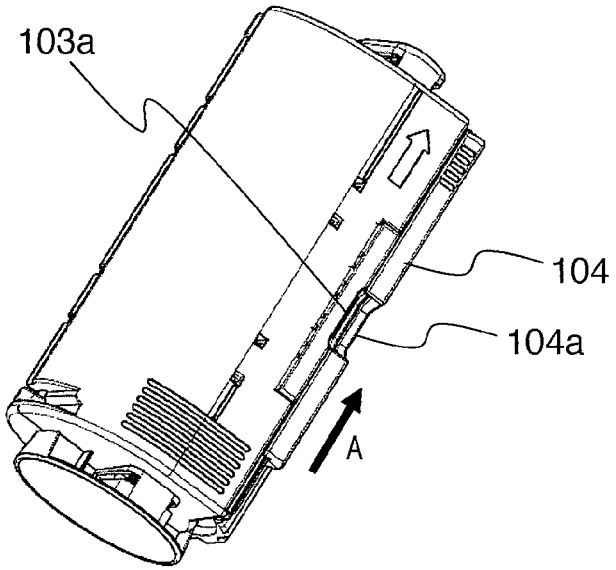
Figure 12A:
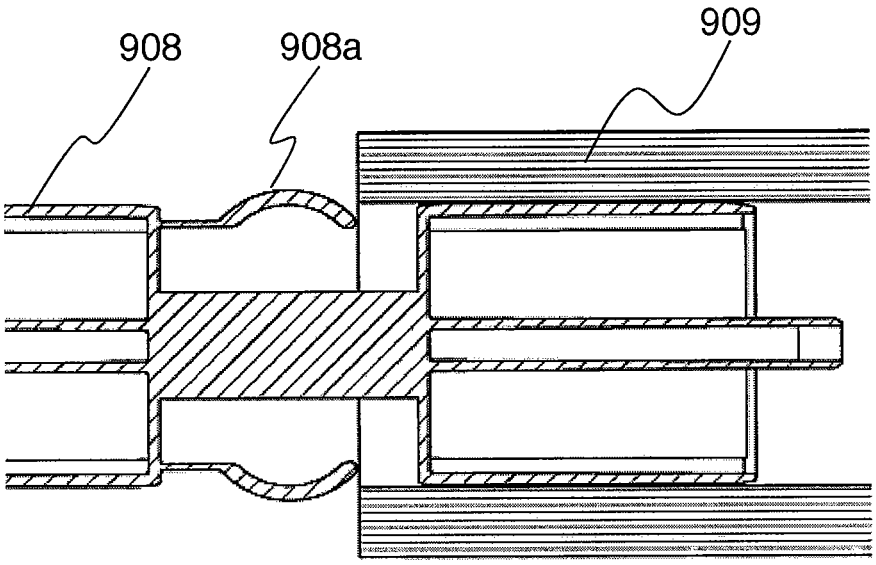
FIGS. 12A and 12B are sectional views for explaining how resin springs deform when the conventional roll paper shaft is attached to roll paper.
Figure 12B:
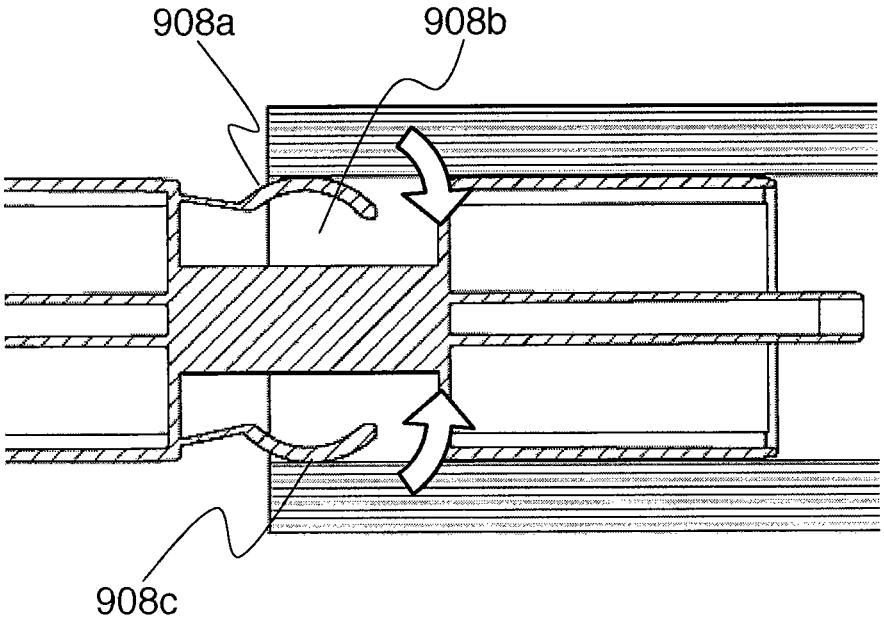
Figure 13A:
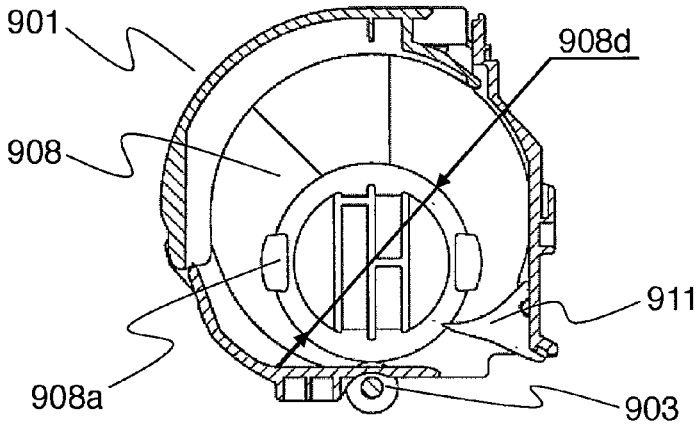
FIGS. 13A to 13C are sectional views showing a state in which the conventional roll paper shaft having no roll paper attached is set in a roll paper storage cassette and paper feeding operation is performed.
Figure 13B:
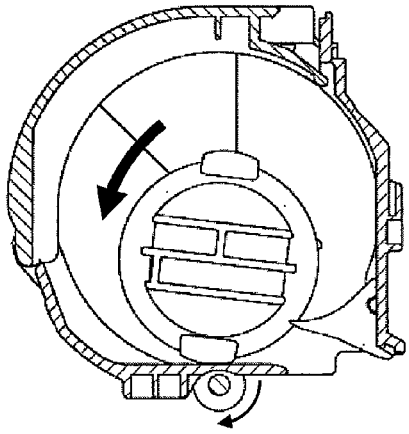
Figure 13C:
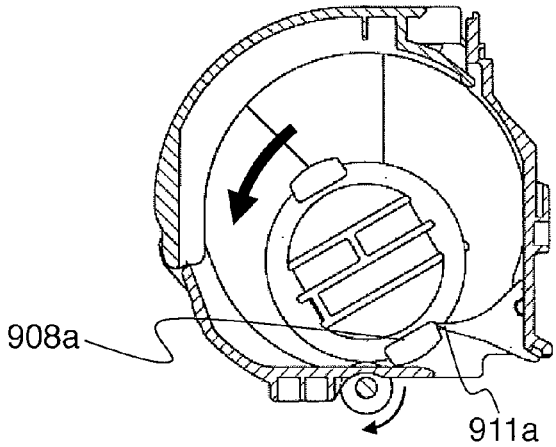

The slide member 104 serves to cover the finger engaging portion 103*a* of the open lever, as shown in FIG. 2A, to prevent the upper case 101 and the lower case 102 from opening when the user carelessly holds the roll paper storage cassette 1 and pushes the open lever 103. If the upper case 101 and the lower case 102 open while the user carelessly holds the roll paper storage cassette 1, the roll paper may drop and become contaminated or bent. When opening the upper case 101, the user slides the slide member 104 in the arrow A direction, and pushes the open lever 103 while aligning a notched portion 104*a* of the slide member with the finger engaging portion of the open lever, thereby opening the upper case 101, as shown in FIG. 12B.

Figure 3:
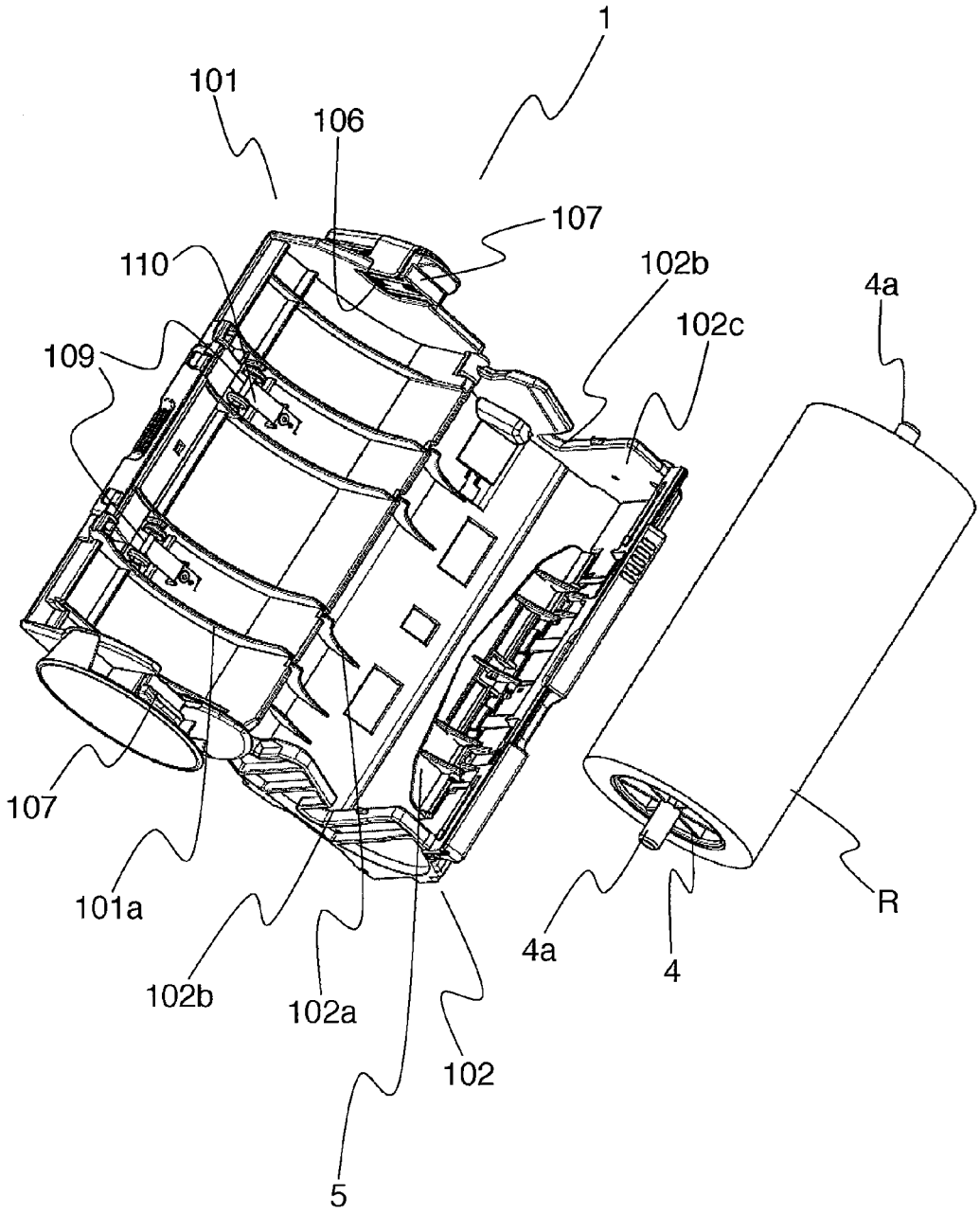
FIG. 3 is a perspective view showing the roll paper storage cassette in an open state and a state in which roll paper is attached to a roll paper shaft.

The arrangement of the roll paper storage cassette 1 will now be described in more detail with reference to FIG. 3.

The roll paper storage cassette 1 mainly includes three components, namely roll paper, a storage case, and a roll paper shaft as paper retaining shaft. For example, when replacing roll paper, the user purchases only the roll paper R and replaces the roll paper set with respect to a roll paper shaft 4 and the roll paper storage cassette 1. In this case, after the roll paper R is used up, the user needs to only discard a small amount of the roll paper R which is left on the roll paper shaft. This saves the trouble of recovering and recycling the roll paper R, thus providing advantages in terms of cost and resource saving. In other cases, the roll paper R wound around the roll paper shaft 4 may be sold with priority being attached to usability, or roll paper set in a roll paper storage cassette may be sold. That is, roll paper can take various kinds of forms in accordance with various purposes.

The roll paper storage cassette 1 includes the upper case 101 and the lower case 102. Ribs 101*a* and 102*a* are provided on the inner surfaces of the cases to reduce conveyance resistance. Grooves 102*b* are provided for the lower case 102 to guide the roll paper shaft 4 inserted into the roll paper R. Pressing springs 106 and pressing guides 107 are mounted on the upper case 101. The pressing springs 106 urge the roll paper shaft 4. The pressing guides 107 can slide in a direction to urge. The pressing springs 106 and the pressing guides 107 are provided on the left and right sides of the upper case 101 to uniformly urge two end portions 4*a* of the roll paper shaft 4.

A pair of rollers 109 are provided for the upper case 101 so as to protrude from the ribs 101*a*, and are urged by urging springs 110 from the back surfaces. Walls 102*c* on the two side surfaces of the lower case 102 serve as walls for restricting the roll paper R in the widthwise direction so as to reduce meandering and positional shifts in the widthwise direction. An offset guide 108 is provided on one side surface of the lower case 102 to urge a portion near the outer surface of the roll paper R. The offset guide 108 can slide in the widthwise direction of the roll paper. A method of urging the offset guide 108 will be described later with reference to FIG. 4. The offset guide 108 serves to prevent backlash and meandering in the widthwise direction of the roll paper R by pressing a portion near the outer surface of the roll paper R.

A pickup guide 5 is provided at the outlet corresponding to the leading end of roll paper to pick up the leading end of the roll paper R. The pickup guide 5 is always urged to the roll paper side by a spring member (not shown). The distal end of the pickup guide 5 slides along the outermost circumference of the roll paper R to reliably pick up the leading end of the roll paper at the time of paper feeding.

Figure 4:
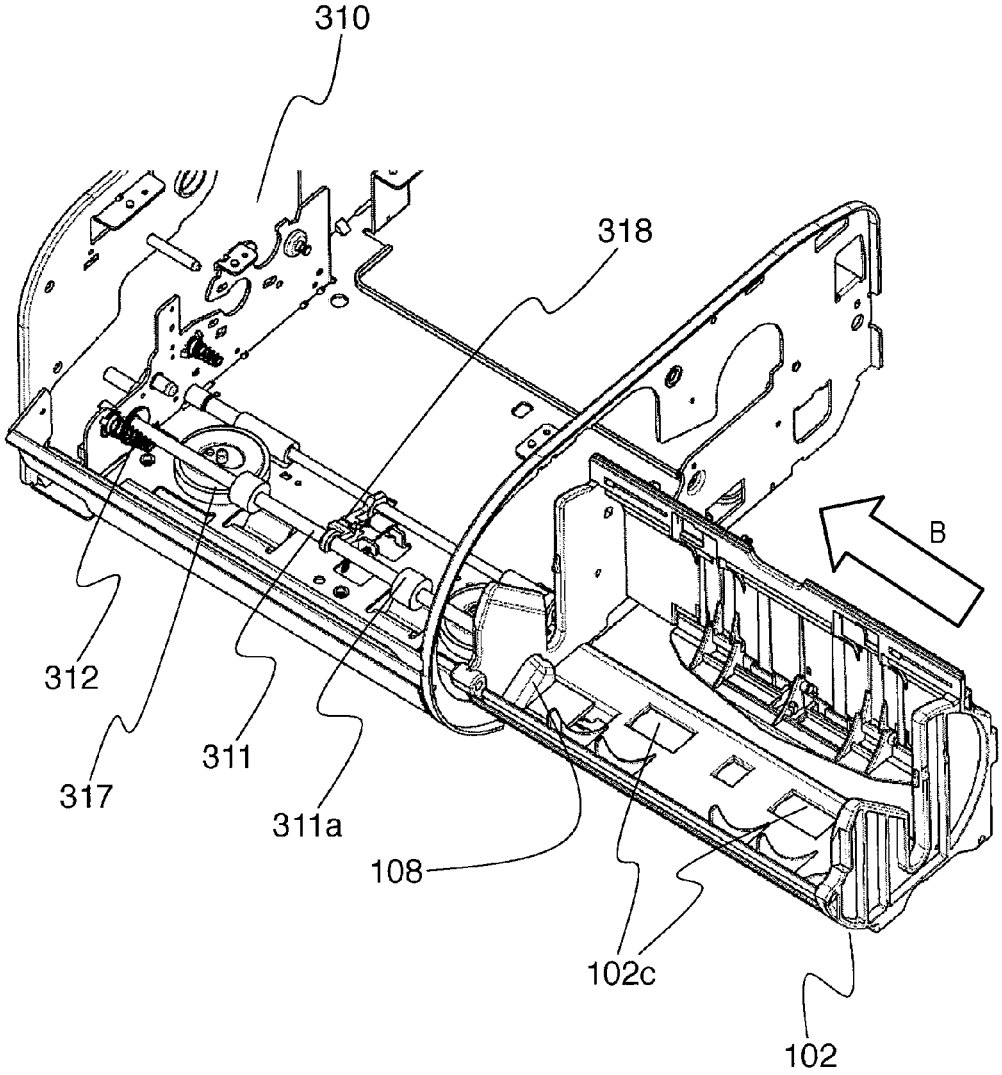
FIG. 4 is a perspective view for explaining a method of urging a roll paper offset guide and a feed roller lifting mechanism.

A method of making the offset guide 108 urge a portion near the outer surface of roll paper and a lifting mechanism for the feed roller will now be described with reference to FIG. 4. FIG. 4 is a perspective view showing the process of loading the roll paper storage cassette 1 in a direction B. FIG. 4 shows the lower case 102 of the roll paper storage cassette 1, a portion 310 of a frame inside the cassette printer main body 3, a feed roller 311, and an urging member 312 of the offset guide 108. FIG. 4 does not show the upper case 101 to best illustrate the structure. The urging member 312 is a conical coil spring, which is mounted on the frame of the printer main body 3. The distal end of the conical coil spring pushes the back surface of the offset guide 108 to urge it when the cassette is loaded into the main body.

The feed roller 311 is placed on the bottom surface side of the lower case 102. The feed roller 311 is lowered to a position where it does not collide with the roll paper storage cassette 1 at the time of cassette loading, and is raised at the time of printing. Rectangular holes 102*c* provided in the lower case 102 are opening portions which rubber portions 311*a* of the feed roller 311 enter. Bearings are provided on the two ends of the feed roller 311 and formed into elongated holes to allow the feed roller 311 to move upward. Two cam gears 317 having cam shapes are arranged on the bottom surface of the frame 310 under the feed roller 311 to raise the feed roller. An urging member 318 for pressing the feed roller 311 downward is provided on the middle portion of the feed roller 311. The feed roller 311 and the cam gears 317 are driven by driving sources and power transmission mechanisms (not shown).

The movement of the pressing guides 107 and the pressing direction of the roll paper shaft 4 will now be described with reference to FIGS. 5A to 5C. FIGS. 5B and 5C are sectional views vertically taken through the center of the feed roller, as indicated by a cross-section D-D in FIG. 5A. FIG. 5B is a sectional view showing a state in which unused roll paper is loaded. FIG. 5C is a sectional view showing a state in which roll paper is used up.

Figure 5A:
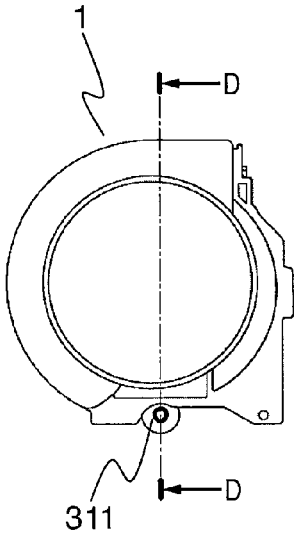
FIGS. 5A to 5C are sectional views for explaining a method of pressing the roll paper shaft.
Figure 5B:
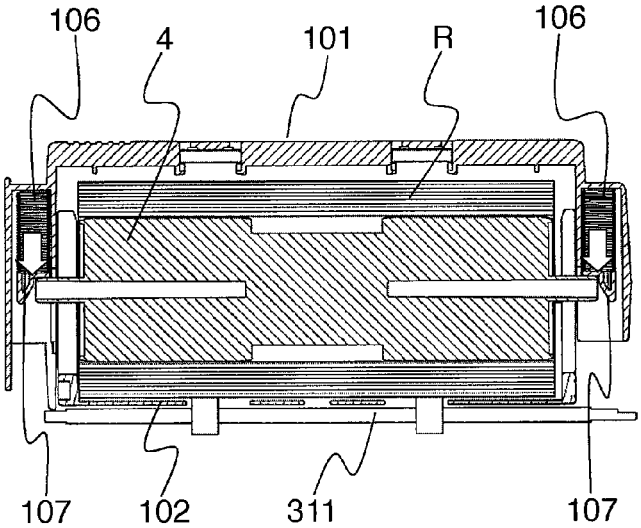
Figure 5C:
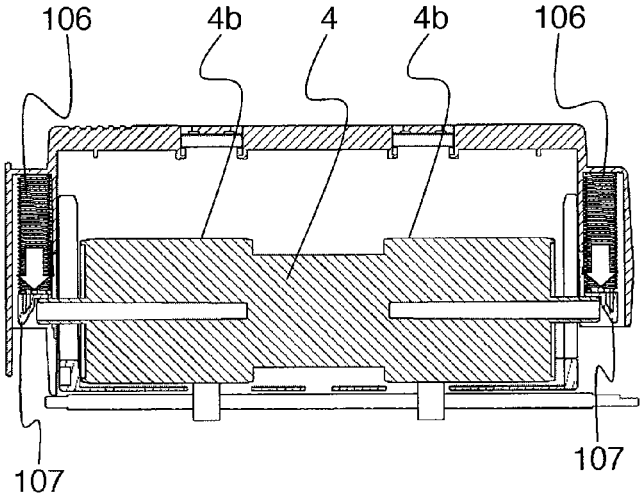

When the user inserts the roll paper shaft 4 into the roll paper R, places the roll paper in the lower case 102, and closes the upper case 101, the pressing springs 106 provided on the left and right sides of the upper case 101 urge the roll paper R in the direction of the bottom surface of the lower case 102 located on the lower side in FIGS. 5A to 5C. In the standalone roll paper storage cassette 1, the roll paper R is clamped between the roll paper shaft 4 and the bottom surface of the lower case 102 to suppress unrolling and backlash of the roll paper R. When the user loads the roll paper storage cassette 1 into the printer main body 3, the roll paper shaft 4 is urged in the direction of the feed roller 311, and the roll paper R is pressed against the feed roller 311 at the time of paper feeding. When the feed roller 311 is rotated in the paper feeding direction while the roll paper R is pressed against the feed roller 311, the roll paper R rotates, and the leading end of the roll paper R can be fed from the outlet of the cassette to the outside.

The pressing springs 106 attached to the cassette upper case 101 urge the roll paper shaft 4 toward the feed roller 311, and transfers the urging force through the pressing guides 107. To reduce the rotational resistance of the roll paper shaft, the pressing guides are desirably made of a material having good sliding properties, such as polyacetal.

When loading the unused roll paper R, the roll paper shaft 4 is at the height shown in FIG. 5B, and the pressing springs 106 are compressed most.

As the number of remaining printable pages decreases, the winding diameter of the roll paper R decreases. When the roll paper R is used up, the roll paper shaft 4 moves downward to the height shown in FIG. 5C, and the pressing springs 106 are stretched.

The pressing force that presses the roll paper R against the feed roller 311 is desirably strong and constant. As described above, however, the pressing springs 106 stretch with a change in the winding diameter of the roll paper R. It is therefore desirable to maximize the winding diameter and the number of turns and reduce the spring constant while securing strong pressing force.

As the rubber portions 311*a* of the feed roller 311, rubber portions having small diameters and widths are used to reduce the size of the printer main body 3 and suppress an increase in cost. Since the roll paper shaft 4 is pressed at the two ends relative to the positions of the rubber portions 311*a* in the widthwise direction of the paper, the rubber portions 311*a* are desirably arranged at two positions spaced apart from each other to suppress meandering of the paper. However, in order to cope with a paper size small in width, the rubber portions 311*a* are arranged slightly inward. Surfaces 4*b* of the roll paper shaft 4 which are opposite to the positions of the rubber portions 311*a* need to be continuous surfaces without any irregularities. This prevents pressure losses and the occurrence of being caught.

The shape of the resin springs and the restriction members provided for the roll paper shaft 4 will now be described with reference to FIGS. 6A to 6C.

Figure 6A:
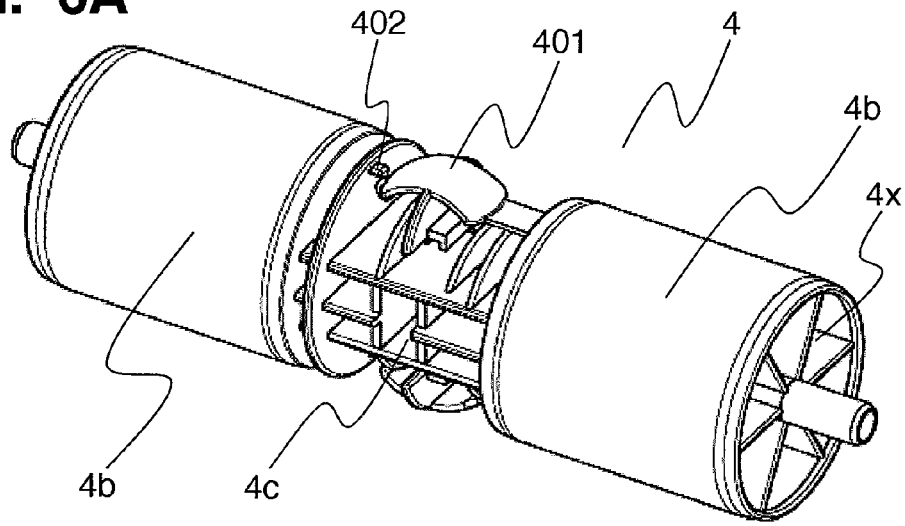
FIGS. 6A to 6C are a perspective view and front views showing the roll paper shaft in the first embodiment.
Figure 6B:
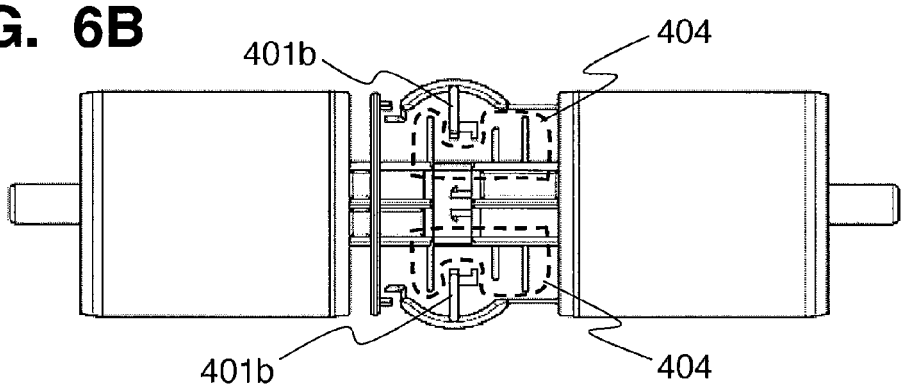

FIG. 6A is a perspective view of the roll paper shaft 4 in this embodiment. FIG. 6B is a front view showing resin springs 401 without load. FIG. 6C is a front view showing a state in which forces are applied to the resin springs 401 in the diameter expanding directions. As shown in FIG. 6B, the resin springs 401 are integrally formed with the roll paper shaft 4. A portion of each resin spring 401 which contacts the inner surface of the hollow portion of the roll paper R has inclined surfaces in the axial direction and the rotational direction. That is, each resin spring 401 has a curved surface shape. Forming each resin spring 401 into a curved surface shape in this manner allows the roll paper R to smoothly slidably make contact with the resin spring 401 when the roll paper shaft 4 extends through the roll paper R, thus allowing the roll paper shaft 4 to rotate without being caught on a step of the hollow portion of the roll paper R which corresponds to the thickness of the roll paper or the leading end of the roll paper when rotating for paper conveying operation.

As described with reference to FIGS. 5A to 5C, since the portions 4*b* opposite to the feed roller 311 need to have cylindrical shapes, thinning portions 4*x* for uniform thickness are provided so as to extend from the two end portions up to the positions where cylindrical portions are required. The middle portion needs to have a thinning portion 4*c* to make the thickness uniform.

Figure 6C:
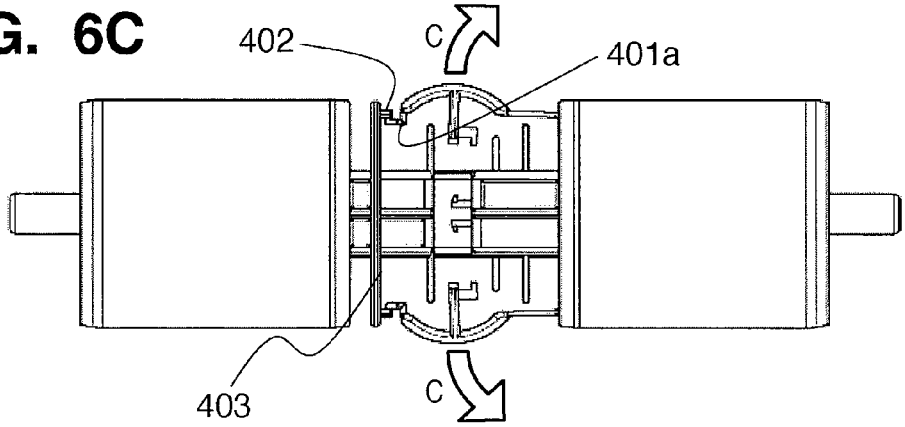

FIG. 6C shows how the resin springs deform when external forces are applied to the resin spring portions in the diameter expanding directions, which are indicated by arrows C. Distal end portions 401*a* of the resin springs 401 are caught on restriction members 402 integrally formed with a disc shaped rib portion 403 opposite to the distal end portions 401*a*. This prevents the resin springs 401 from stretching further. This restricts the amounts of deformation of the resin springs 401 so as not to make them deform to the plastic deformation range, thereby reducing the possibility of breakage.

In addition, in order to prevent the user from displacing the resin springs 401 upward with his/her fingers, ribs 404 are formed in the spaces below the resin springs 401 in consideration of the retreat positions of the resin springs. This makes it difficult for the user to insert his/her fingers to inhibit he/she from pushing the resin springs 401, thereby preventing he/she from bending the resin springs up to plastic deformation.

Printing operation will now be described with reference to FIG. 7. A motor (not shown) is driven to rotate the feed roller 311 and rotate the loaded roll paper R counterclockwise. As the roll paper R rotates, the pickup guide 5 picks up the leading end of the roll paper portion located on the outermost circumference of the roll paper R, and feeds the roll paper toward the outlet of the cassette.

Figure 7:
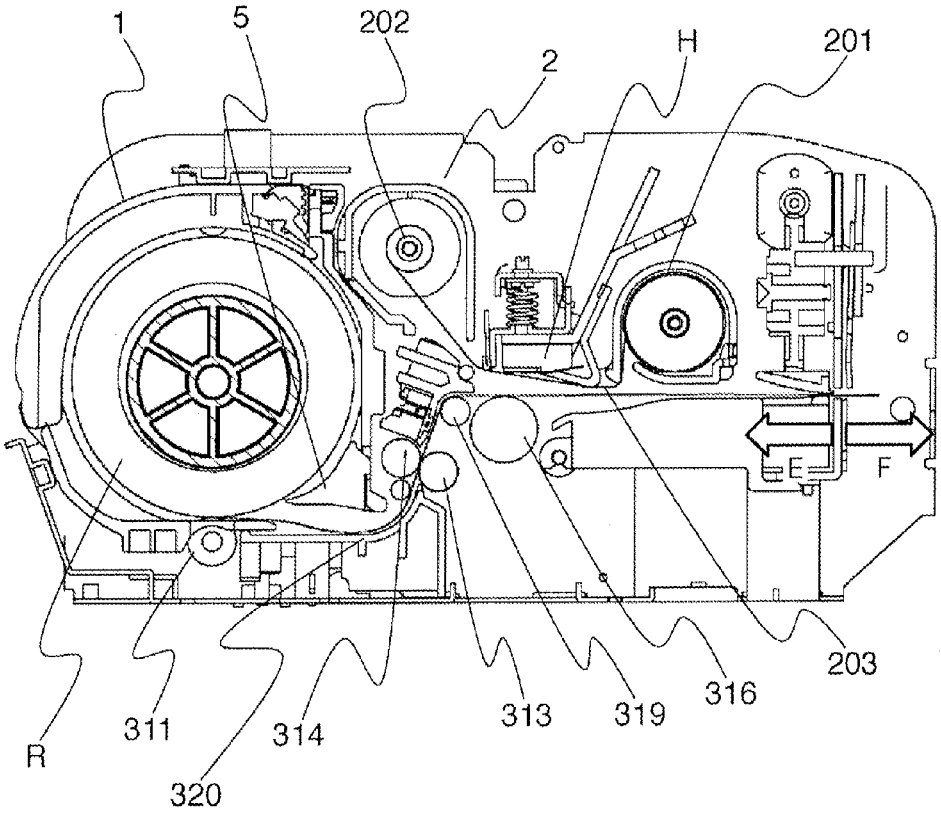
FIG. 7 is a sectional view showing the interior of the printer at the time of printing.

A paper guide 320 guides the roll paper fed from the roll paper storage cassette 1, changes its traveling direction to the upper side in FIG. 7, and conveys the roll paper between a grip roller 313, which is rotated/driven by the same driving source as that for the feed roller, and a pinch roller 314 serving as a driven roller. A pressing mechanism (not shown) presses the pinch roller 314 against the grip roller 313. The minute projections of the grip roller 313 bite the back surface of the roll paper R to accurately convey the roll paper by a desired distance.

A rotating shaft provided for the printer main body 3 retains a supply bobbin 201 and take-up bobbin 202 of the ink ribbon cassette 2 by making the bobbins engage with the shaft. The supply bobbin 201 is on the driven side, and rotates while receiving rotational resistance so as to apply proper tension to the ink ribbon. The take-up bobbin 202 is rotated/driven by the same driving source as that for the grip roller 313, and is rotated/driven via a torque limiter at the time of printing.

The paper feeding direction at the time of printing is the direction indicated by an arrow E. The roll paper is extracted in advance at the time of paper feeding by a length required for printing. The printer then performs printing while pressing a thermal head H against a platen roller 316, conveying the roll paper to the roll paper storage cassette 1 using the grip roller 313, and taking up the printed portion. The thermal head H and the platen roller 316 convey the roll paper R and an ink ribbon 203 while they are in tight contact with each other. When they are placed on the thermal head H in a line, a heating element generates heat in accordance with print data, thereby forming an image.

The printer of this embodiment is a sublimation printer. When printing a color image such as a photographic image, yellow, magenta, and cyan colors must be superimposed. For this reason, when completing yellow printing as the first color printing, the printer conveys the roll paper to the printing start position again, and starts magenta printing. The printer reciprocally conveys the roll paper by the number of times corresponding to the number of ink layers. Upon completion of printing of all the layers, the printer cuts a printed portion extending from the leading end of the roll paper R or a marginal portion, and delivers the roll paper to the outside. If there is an image to be printed next, the printer conveys paper to the printing start position and starts printing operation. If there is no image to be printed next, the printer rotates the feed roller 311 in the direction opposite to that at the time of paper feeding to completely rewind the roll paper R into the roll paper storage cassette 1. After the cassette contains the roll paper, the printer lowers the feed roller 311 to the retreat position and enters the standby state.

Figure 8A:
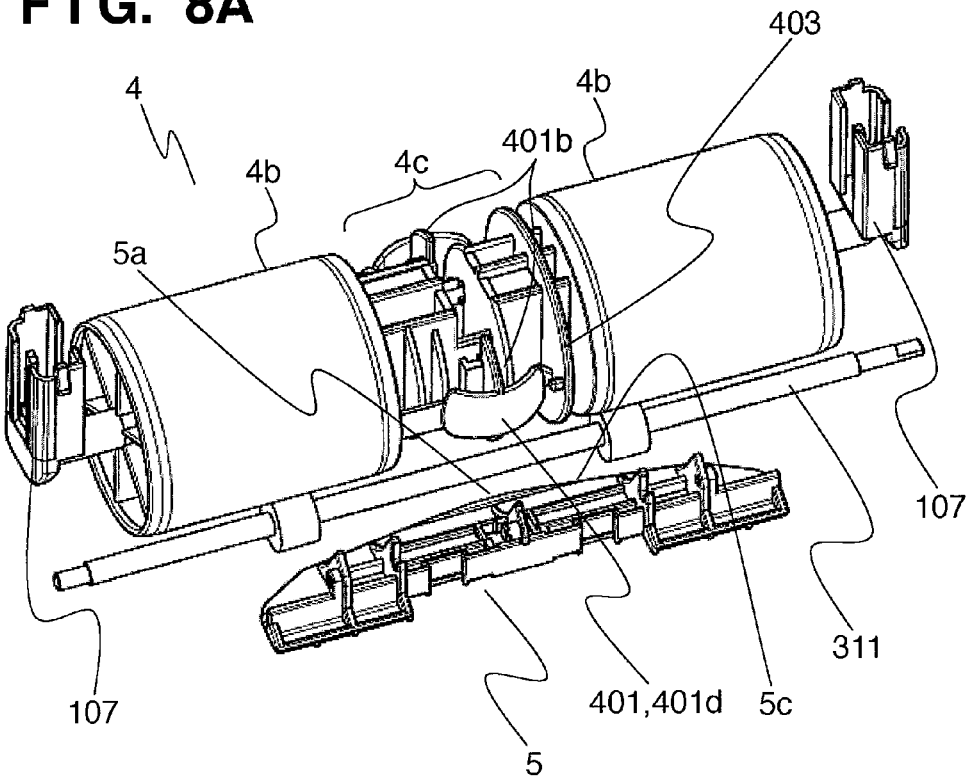
FIGS. 8A and 8B are a perspective view showing the relationship between the roll paper shaft and a pickup guide and an enlarged view of a resin spring in the first embodiment.
Figure 8B:
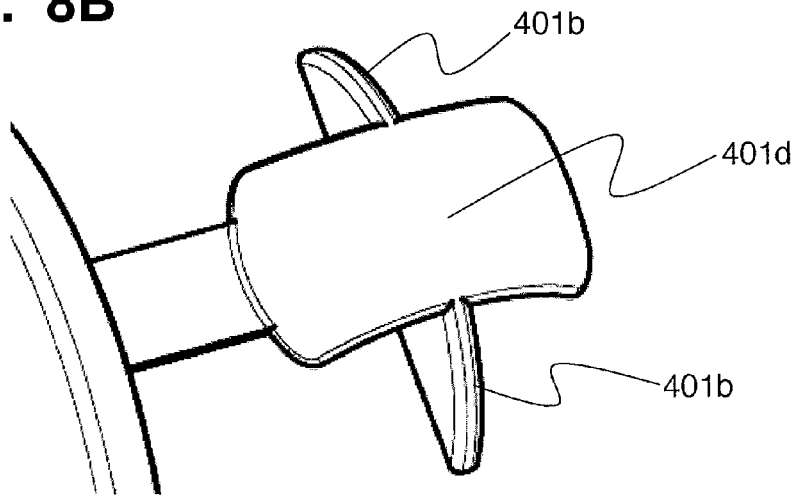

FIG. 8A shows the positional relationship between the roll paper shaft 4 in the roll paper storage cassette, the feed roller 311, and the pickup guide 5. FIG. 8B is an enlarged view of the resin spring 401. Referring to FIG. 8A, the height of the roll paper shaft 4 corresponds to the height to be set when unused roll paper is loaded. The pressing guides 107 press the two ends of the roll paper shaft 4. The portions 4*b* of the roll paper shaft 4 which are pressed against the feed roller 311 are cylindrical, and the middle portion 4*c* of the shaft has a thinning shape. The thinning portion 4*c* is provided with the resin springs 401.

A pickup guide distal end 5*a*, the thinning portion 4*c* of the roll paper shaft 4, and the resin springs 401 are placed at aligned positions. As the remaining amount of the roll paper R decreases, the roll paper shaft 4 moves downward to make the resin spring 401 and the pickup guide distal end 5*a* positionally interfere with each other. Each resin spring 401 in this embodiment has a rib portion 401*b* which contacts the pickup guide distal end 5*a* before a pressing surface 401*d* of the resin spring 401 contacts the pickup guide distal end 5*a*. The rib portion 401*b* extends in the rotational direction and is continuous with the pressing surface 401*d*. With this structure, the pickup guide distal end 5*a* is contacted and picked up by the rib portion 401*b* of the resin spring 401 without being caught on the resin spring 401 or the rib portion 401*b* of the resin spring 401 slips under the pickup guide distal end 5*a*, thereby preventing them from interfering with each other.

In addition, the disc shaped rib portion 403 is additionally provided to prevent the pickup guide distal end 5*a* from excessively entering the thinning portion 4*c* of the roll paper shaft 4. With this structure, making a portion 5*c* of the pickup guide make contact with the rib portion 403 of the resin spring 401 makes the rib portion 401*b* of the resin spring 401 contact and pick up the pickup guide distal end 5*a* and restricts the amount of entrance so as to inhibit the pickup guide distal end 5*a* from approaching the roll paper shaft 4 by a predetermined distance or more.

A case in which the roll paper shaft 4 without the roll paper R is loaded into the roll paper storage cassette 1, and paper feeding operation is performed will now be described with reference to FIGS. 9A to 9C.

Figure 9A:
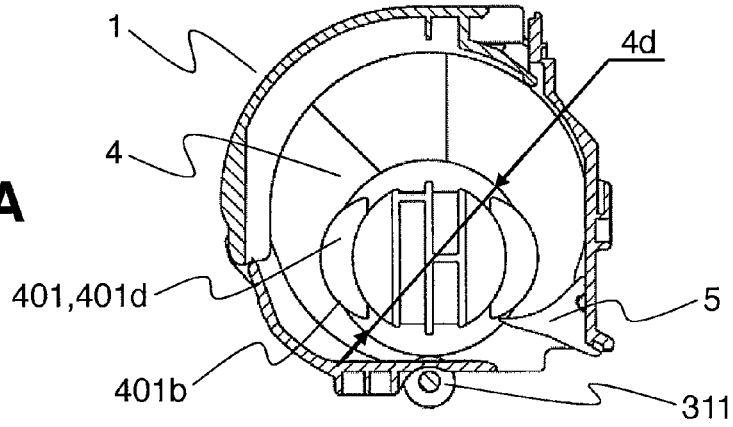
FIGS. 9A to 9C are sectional views showing a state in which the roll paper shaft having no roll paper attached is set in the roll paper storage cassette and paper feeding operation is performed in the first embodiment.
Figure 9B:
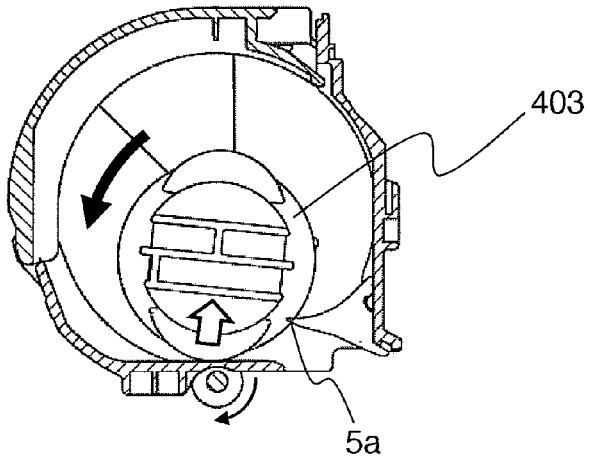

At the start of rotation in FIG. 9A, the resin springs 401 are in a free state and protrude outside a maximum outer diameter 4*d* of the roll paper shaft 4. As the roll paper shaft 4 rotates from this state, the resin spring 401 contacts the bottom surface of the roll paper storage cassette 1, as shown in FIG. 9B. As a consequence, the roll paper shaft 4 is pressed downward in FIG. 9B, and hence the resin spring 401 deforms first and displaces inward from the maximum outer diameter 4*d* of the roll paper shaft 4. This allows the resin spring 401 to rotate without being caught on the pickup guide distal end 5*a*. At this time, part of the pickup guide 5 is in contact with the disc shaped rib portion 403 of the roll paper shaft 4 to be restricted so as to inhibit the pickup guide distal end 5*a* from further entering the thinning portion 4*c*.

Figure 9C:
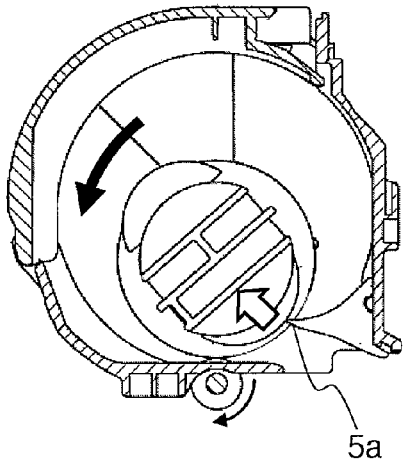
Figure 10A:
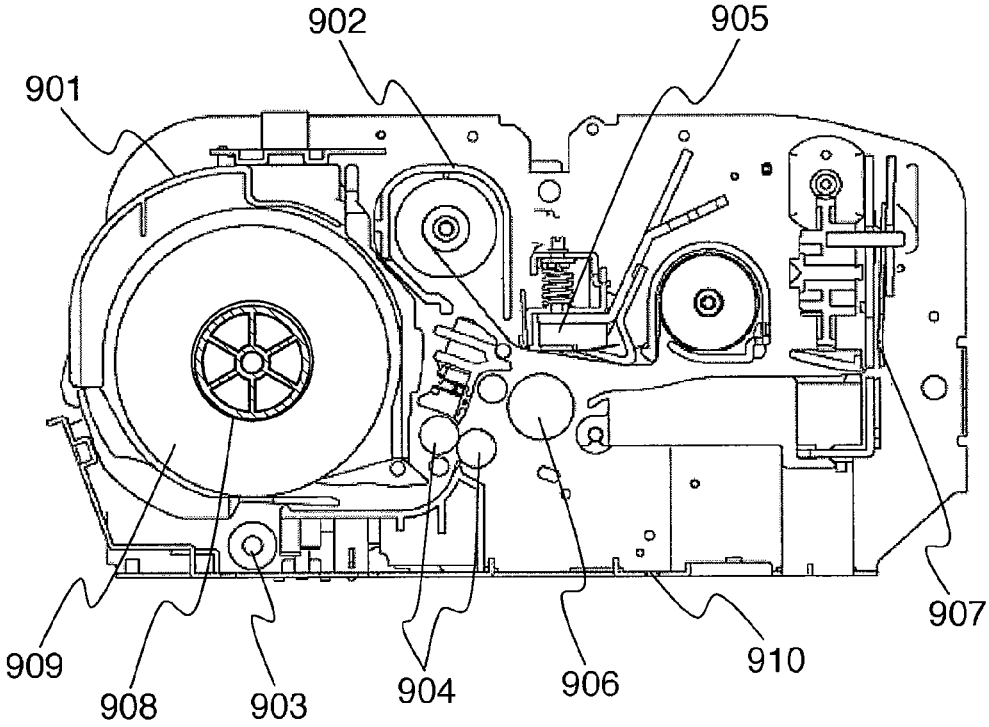
FIGS. 10A and 10B are sectional views showing the interior of a conventional printer.
Figure 10B:
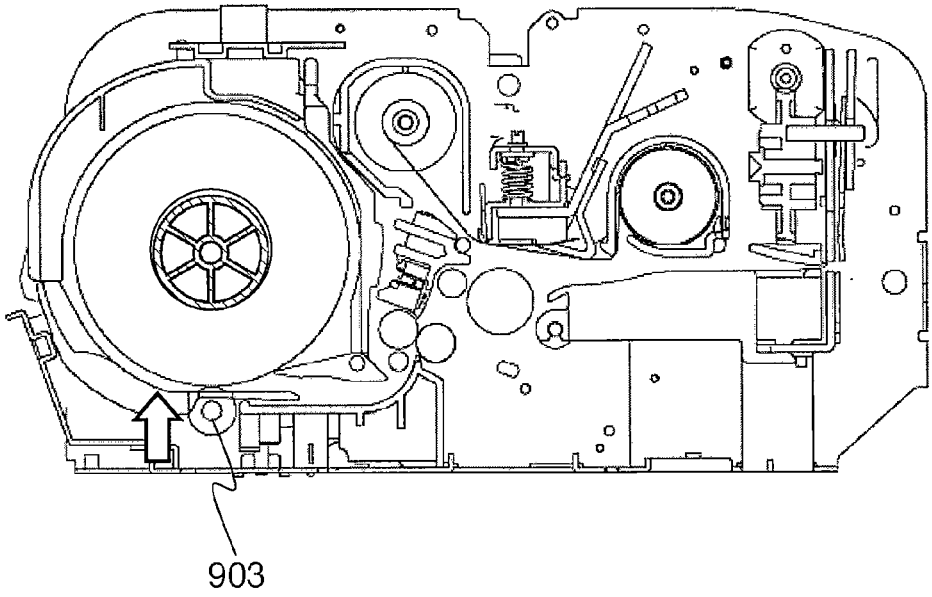
Figure 11:
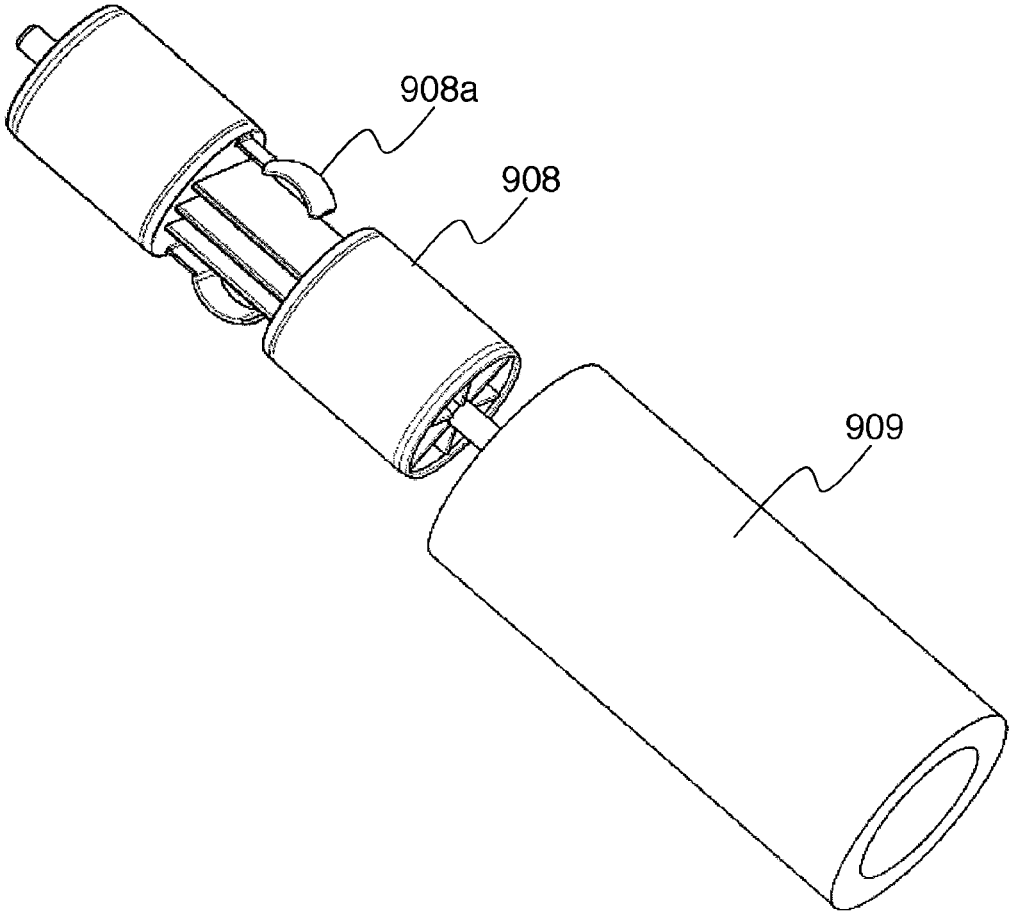
FIG. 11 is a perspective view showing a conventional roll paper shaft and roll paper.

At the time of rotation in FIG. 9C, the rib portion 401*b* of the resin spring 401 contacts and picks up the pickup guide distal end 5*a*, and the resin spring 401 further deforms. This allows the roll paper shaft to keep rotating while inhibiting the pickup guide distal end 5*a* from being caught on the resin spring 401. The same effect can be obtained at the time of rotation in the opposite direction. Making the resin springs 401 or the pickup guide 5 retreat allows the roll paper shaft to rotate without being caught on it.

In this embodiment, in order to achieve low cost, the resin springs and the restriction members are integrally formed. However, they may be discrete members. In addition, when using metal springs, it is possible to obtain the same effect as that described above by integrally or discretely providing restriction members and rib portions.

This embodiment has exemplified the case in which the pickup guide 5 is provided for the roll paper storage cassette 1. It is, however, possible to implement an arrangement without the roll paper storage cassette 1 or provide the pickup guide 5 for the printer main body as long as the positional relationship between the roll paper shaft 4 and the pickup guide 5 remains the same.

Second Embodiment

The second embodiment will be described below. When printing on roll paper, it is necessary to make a printer recognize the end position of the printable roll paper. The printer can recognize the end position of the roll paper by detecting an end detection mark formed on the roll paper. For example, a through hole is formed in part of roll paper, and an end sensor such as a photoreflector in the printer detects the through hole. Alternatively, a low-reflectance seal different from roll paper is pasted on the roll paper or roll paper is coated with a low-reflectance paint to form an end detection mark, and an end sensor in the printer detects the mark. The above end detection mark is obtained by forming a through hole in part of roll paper. Alternatively, this mark is obtained by forming part of the surface of roll paper into a slightly convex portion corresponding to the thickness of a seal pasted on the surface of the roll paper, or by pressing part of the surface of roll paper with, for example, a thermal head into a concave shape.

Assume, however, that the above roll paper is repeatedly reciprocated by the feed roller while being pressed by the roll paper shaft. In this case, if there is an end detection mark near the roll paper shaft, the shape of part of the end detection mark may be transferred onto the roll paper, or a print may be transferred onto the roll paper when it is rewound. Executing printing on a portion of such roll paper onto which a shape or print has been transferred will cause print irregularity or an unexpected print transfer trace occurs because the surface around the portion is not smooth, resulting in a deterioration in print quality. Therefore, if there is the above through hole or concave/convex shape on the surface of roll paper, the above shape transfer or print transfer is made difficult to occur by making it difficult for the feed roller or the like to apply a pressure onto the surface having the above through hole or concave/convex shape.

The specification of Japanese Patent No. 3861727 discloses a method of making it difficult to apply a pressure to a surface of roll paper which has a through hole or concave/convex shape. According to the specification of Japanese Patent No. 3861727, paper is used, which is obtained by integrally bonding paper having a heat sensitive dye to a separator with an adhesive. The separator has a cutting line parallel to the paper feeding direction. This cutting line is formed in a region other than a region to which a pickup roller and an urging spring are commonly opposite. The cutting line portion is lifted from the separator, and a high pressure is applied to only the lifted portion, thereby preventing color development due to frictional heat.

According to the specification of Japanese Patent No. 3861727, the pressing means includes a pressing plate and an urging spring. The urging spring urges paper against the pickup roller through the pressing plate. The pressing plate is required to press paper against the surface of the pickup roller while making the paper squarely face it, and to feed the paper upon receiving a frictional force from the pickup roller, and hence is regarded to have relatively high rigidity.

In the arrangement disclosed in the specification of Japanese Patent No. 3861727, the pressing plate receives the force of the urging spring, and the urging force is diffused by the pressing plate. The pressing force is then transferred to the paper through the pressing plate. Finally, the pickup roller supports the paper. That is, portions immediately under the urging spring and the pressing plate and the pickup roller paper support surface are portions on which the pressure generated by the urging spring acts relatively strongly.

In addition, a cutting line portion corresponding to a concave/convex shape is located immediately under the urging spring, at the front side of the pickup roller, or immediately under the pressing plate. Although no high pressure is applied to the cutting lines of all the paper clamped between the pressing plate and the pickup roller, a relatively high pressure is applied to paper near regions adjacent to three positions immediately under the urging spring, at the front side of the pickup roller, and immediately under the pressing plate. This increases the pressure on the cutting line portion to cause color development on the cutting line portion. That is, this method does not provide sufficient countermeasures.

An object of the second embodiment is to prevent the occurrence of shape transfer and print transfer onto roll paper near a shaped portion on the surface of the roll paper.

Figure 14A:
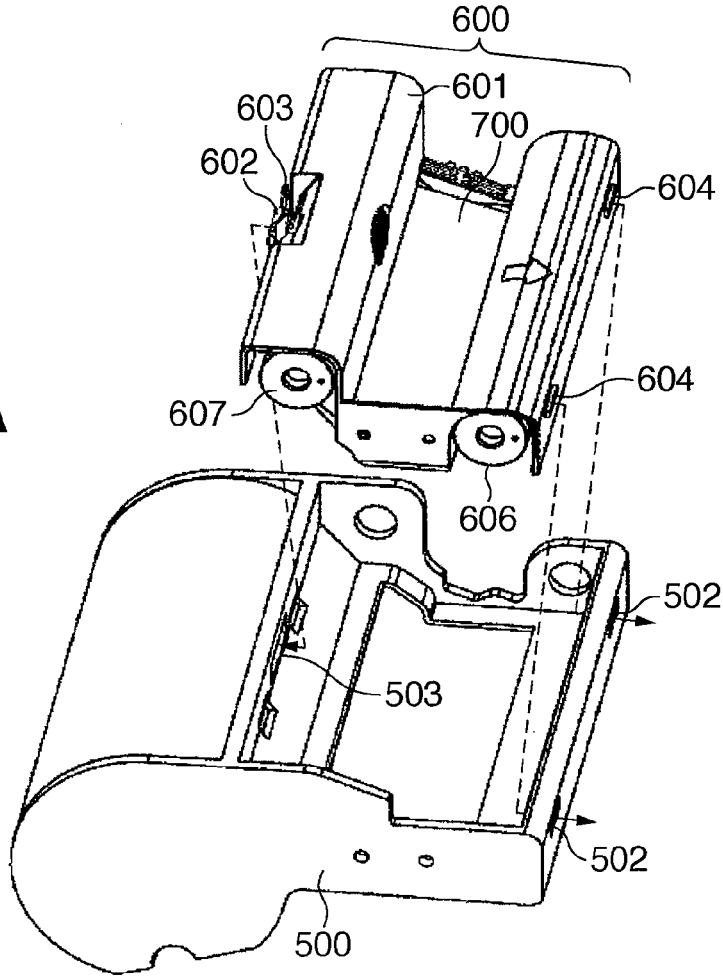
FIGS. 14A and 14B are perspective views showing an ink ribbon cassette and a cassette main body in the second embodiment.

FIG. 14A is a perspective view showing how an ink ribbon cassette is loaded into a cassette main body in this embodiment. Referring to FIG. 14A, reference numeral 600 denotes an ink ribbon cassette; 601, a cassette case; 602, an ink ribbon take-up protruding portion which engages with a cassette main body 500, is integrally formed with the cassette case 601, and is provided on a lever portion 603 which can be elastically deformed by pressing operation by the user; 604, an ink ribbon supply protruding portion which engages with the cassette main body 500; 700, an ink ribbon; 606, a supply bobbin around which an unused ribbon coated in advance with sublimation ink and having a necessary length is wound; and 607, a take-up bobbin around which the other end of the ink ribbon 700 is wound. The user inserts the ink ribbon supply protruding portion 604 of the ink ribbon cassette 600, on which these components are mounted, into an ink ribbon supply engaging hole 502 formed in the cassette main body 500. The user then engages the ink ribbon take-up protruding portion 602 with an ink ribbon recovery engaging hole 503 while elastically deforming the lever portion 603.

Figure 14B:
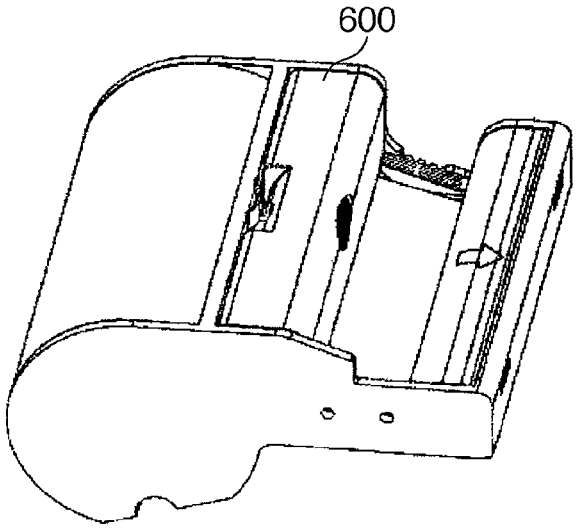

FIG. 14B is a perspective view showing a state in which the ink ribbon cassette of this embodiment is loaded in the cassette main body. Referring to FIG. 14B, the engaging portions 502 and 503 at the above three positions retain the ink ribbon cassette 600 integrally with the cassette.

Figure 15A:
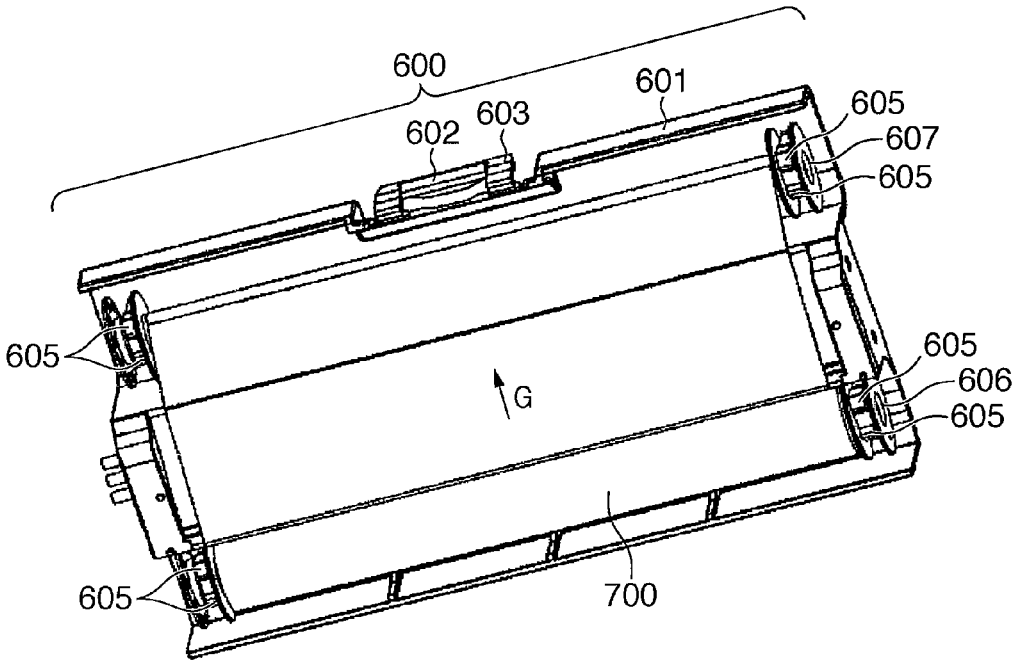
FIGS. 15A and 15B are views showing the ink ribbon cassette and an ink ribbon in the second embodiment in detail.

FIG. 15A is a perspective view showing the ink ribbon cassette according to this embodiment when viewed from the lower surface. As described with reference to FIG. 14A, the unused ink ribbon 700 is wound around the supply bobbin 606, and a plurality of U-shaped bobbin retaining portions 605 integrally formed with the cassette case 601 rotatably retain the two ends of the supply bobbin 606. Likewise, a plurality of U-shaped bobbin retaining portions 605 rotatably retain the two ends of the take-up bobbin 607 around which a used ink ribbon is wound.

Figure 15B:
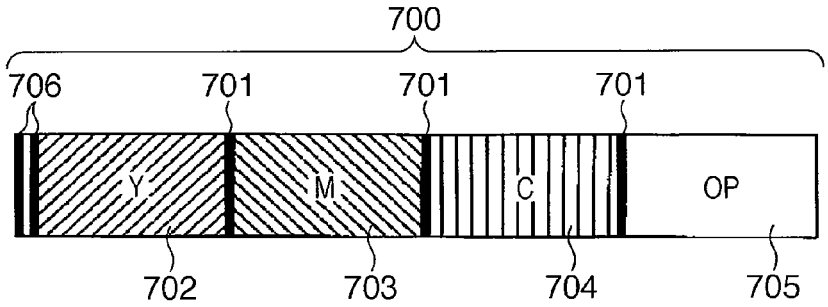

FIG. 15B shows the details of the ink ribbon. The ink ribbon is sublimated by heat from the thermal head H while being taken up in a direction G to transfer ink onto roll paper R. The ink ribbon 700 is sequentially coated with Y ink (yellow color) 702, M ink (magenta color) 703, C ink (cyan color) 704, and OC thermofusible ink (overcoat layer) 705 in the order named from the start. Black bars 701 and a series of ribbon head black bars 706 are formed between inks of four colors to allow an electrical photosensor to detect each ink head position. The ink ribbon 700 shown in FIG. 15B is a unit ink ribbon basically required for one print. An ink ribbon continuously having such unit ink ribbons is wound around the supply bobbin 606 by the number of times corresponding to a necessary number of prints.

The arrangement of roll paper in this embodiment will now be described with reference to FIGS. 16A to 16C.

Figure 16A:
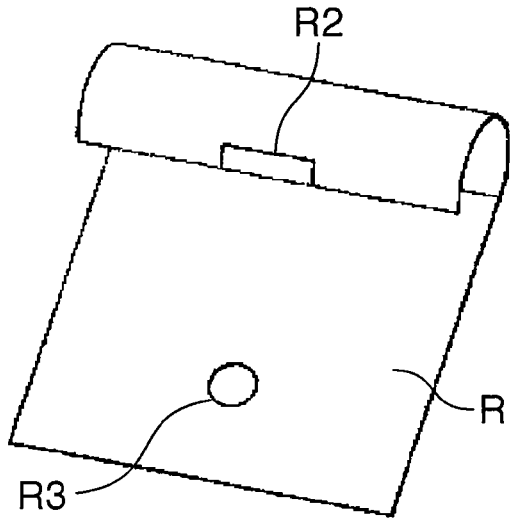
FIGS. 16A to 16C are views showing roll paper in this embodiment in detail.

FIG. 16A shows the end portion of roll paper R, which is corelessly wound with the inner surface on the winding side of the roll paper R being the printing surface. Reference symbol R2 denotes a double-sided tape pasted on a portion in the widthwise direction near the winding start end portion. The double-sided tape R2 is bonded to an area which is not opposite to areas W11 and W141 (to be described later with reference to FIGS. 20A to 20C) to avoid the influence of the thickness of the double-sided tape R2 on shape transfer onto the paper which the double-sided tape R2 overlaps. However, in order to improve the productivity of roll paper which is wound at high speed with a high tensile force, the double-sided tape R2 needs to have a certain pasting length. In order to prevent shape transfer, however, a joining portion for the formation of a hollow portion is desirably provided in an area which is not opposite to the areas W11 and W141. Although this embodiment uses the double-sided tape, it is possible to use an adhesive for joining or insert an end portion in a slit provided in the surface of roll paper.

A circular hole R3 is provided in an almost middle portion in the widthwise direction of roll paper at a position spaced apart from the hollow portion by a predetermined length. The hole R3 is an end detection mark which is provided in the surface of roll paper to allow an optical detection means such as a photoreflector provided on the printer side to detect the end of the roll paper. Depending on the detection performance of the optical detection means or a detection method, it is possible to provide a portion formed into a convex or concave shape to a degree that does not extend through the surface of roll paper instead of a hole or engrave the surface of roll paper while coloring it with a laser or the like. The shape of the hole R3 is not limited to a circle, and may be a belt-like shape or atypical shape. Either of these end detection marks is formed to extend through or form a convex/concave pattern on the surface of roll paper.

Figure 16B:
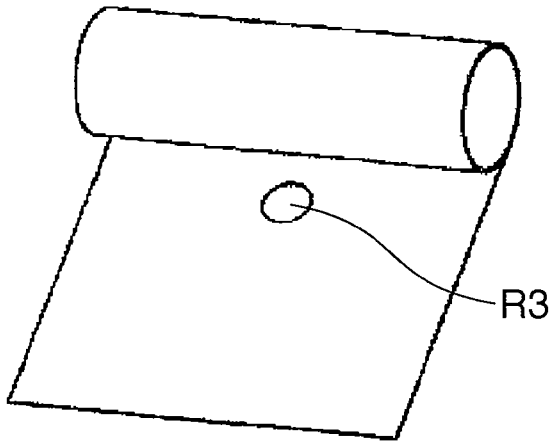

FIG. 16B shows the hollow portion of roll paper. The end portion of the roll paper on which the double-sided tape R2 is pasted is pasted on a portion of the roll paper so as to have a predetermined coreless diameter. The roll paper R having the hole R3 is then taken up inward and wound by a necessary length with a predetermined tensile force while the coreless diameter is maintained, thereby forming roll paper. The hole R3 is located at a position spaced apart from the hollow portion by a length in the convey direction which can be detected by the optical sensor of the printer.

Figure 16C:
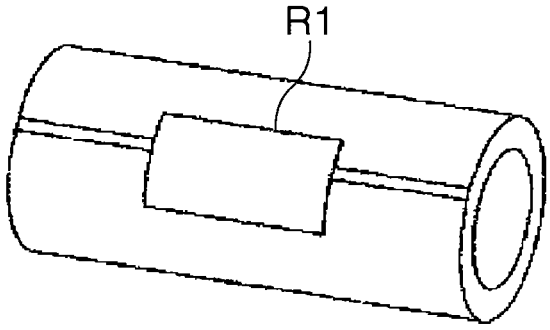
Figure 17A:
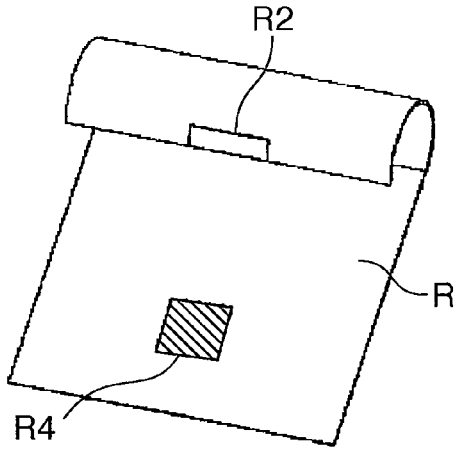
FIGS. 17A and 17B are views showing another example of roll paper in this embodiment.
Figure 17B:
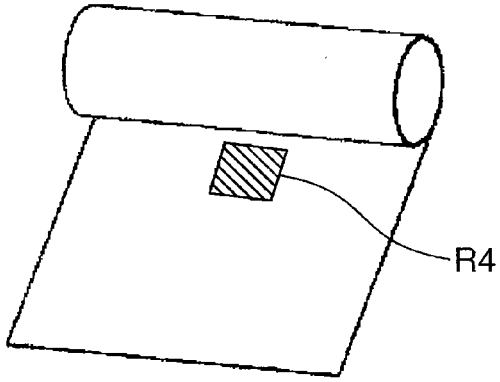

FIG. 16C shows an outer appearance of unused roll paper. The leading end of the roll paper is fixed with a roll paper leading end fixing seal R1. The adhesive surface of the roll paper leading end fixing seal R1 is composed of an adhesive layer that can be peeled off again. This makes it difficult for the adhesive to remain on the roll paper after the seal is peeled off. In addition, a peeling instruction or the like for the user is displayed on a surface portion of the seal R1. FIGS. 17A and 17B show the details of roll paper in another embodiment. FIG. 17A shows a state in which the roll paper is begun to be wound. The double-sided tape R2 is pasted on a portion near the winding start end portion in the widthwise direction. A low-reflectance color seal R4 is pasted, as an end detection mark for the detection of the end of the roll paper, on an almost middle portion in the widthwise direction of the roll paper which is spaced apart from the hollow portion by a predetermined length in the lengthwise direction. The low-reflectance color seal R4 is obtained by bonding a base material portion coated with a low-reflectance material and a double-sided tape having adhesiveness, and has a certain thickness. This seal is pasted on the surface of the roll paper to form a convex shape protruding from the surface of the roll paper. The seal has a rectangular shape. However, the seal is not limited to this shape as long as it can be detected by an optical detection means. Although FIGS. 17A and 17B exemplify the seal, an end detection mark may be directly printed on the surface of the roll paper. For example, low-reflectance ink is transferred onto the surface of roll paper by thermal transfer, or the surface is directly coated with low-reflectance ink. Even in a case in which an end detection mark is directly printed on the surface of roll paper, the surface of the roll paper is made to have convex/concave pattern by an end detection mark for the detection of the end of the roll paper, such as a concave shape on the surface of the roll paper which is formed by ink compression in thermal ink transfer or a convex shape on the surface of the roll paper which is formed by a printed coating film by ink coating.

FIG. 17B shows the hollow portion of the roll paper. The end portion of the roll paper on which the double-sided tape R2 is pasted is pasted on a portion of the roll paper to form a hollow portion. The roll paper R is then wound by a necessary length with a predetermined tensile force, with the surface on which the seal R4 is pasted being the inner surface, while the hollow portion is maintained, thereby forming roll paper.

Figure 18:
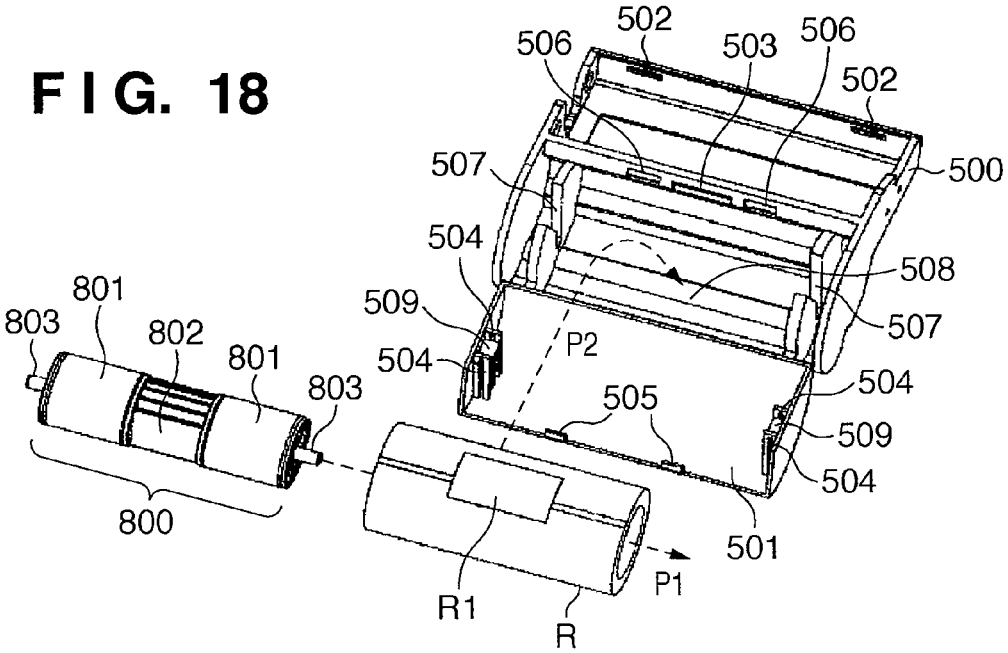
FIG. 18 is a perspective view of a cassette main body in this embodiment when roll paper is loaded in the cassette main body.

FIG. 18 is a perspective view showing how roll paper is loaded into the cassette main body in this embodiment. The cassette main body 500 includes a cover portion 501 pivotally retained by a hinge (not shown), which is in an open state in FIG. 18. A plurality of cover portion lock pawls 505 are provided on an end portion of the cover portion 501. While the cover portion 501 is closed, the cover portion lock pawls 505 engage with cover portion lock holes 506. The cover portion 501 includes pressing levers 509 which press a roll paper shaft 800 inserted in the hollow portion of the roll paper R. The pressing levers 509 are fitted in engaging grooves 504 of the two side end portions of the cover portion 501, and are retained to be movable in the pressing direction while being pressed by urging springs (not shown).

The roll paper R is wound with the printing surface being the inner surface, and the outermost circumferential portion is fixed with a leading end fixing seal R1. The roll paper shaft 800 is inserted into the hollow portion of the roll paper R. The roll paper shaft 800 has rotating shafts 803, each having the smallest outer diameter, at the two end portions, which are rotatably supported and retained by groove-like support portions 507 formed in the two sides of a roll paper storage portion 508 of the cassette main body 500. Reference numeral 801 denotes large-diameter portions of the roll paper shaft 800, which have smooth surfaces without any irregularities; and 802, a small-diameter portion which extends from the middle of the roll paper shaft and has a diameter smaller than the largest outer diameter. The small-diameter portion 802 is formed into a shape from which portions corresponding to "sinks" are thinned out in advance by resin molding.

When loading the roll paper R into the cassette main body 500, the user inserts the roll paper shaft 800 into the hollow portion of the roll paper R in a direction P1, and then loads the roll paper as indicted by an arrow P2 while fitting the two rotating shafts 803 of the roll paper shaft 800 in the support portions 507. Upon loading the roll paper, the user peels off the roll paper leading end fixing seal R1, and then pushes the cover portion 501 until the lock pawls 505 are locked in the lock holes 506, thereby completing the loading operation.

Figure 19A:
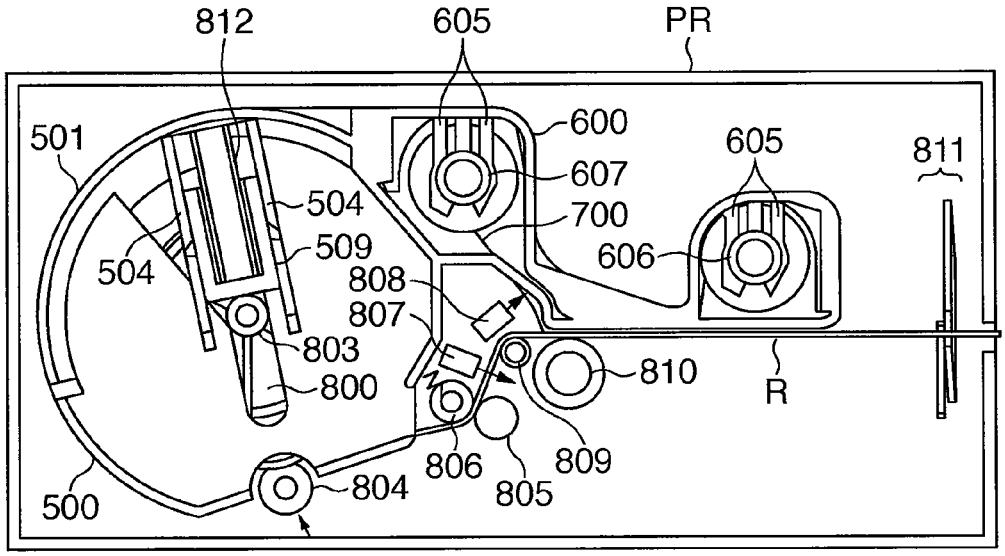
FIGS. 19A and 19B are sectional views of a printer according to this embodiment.
Figure 19B:
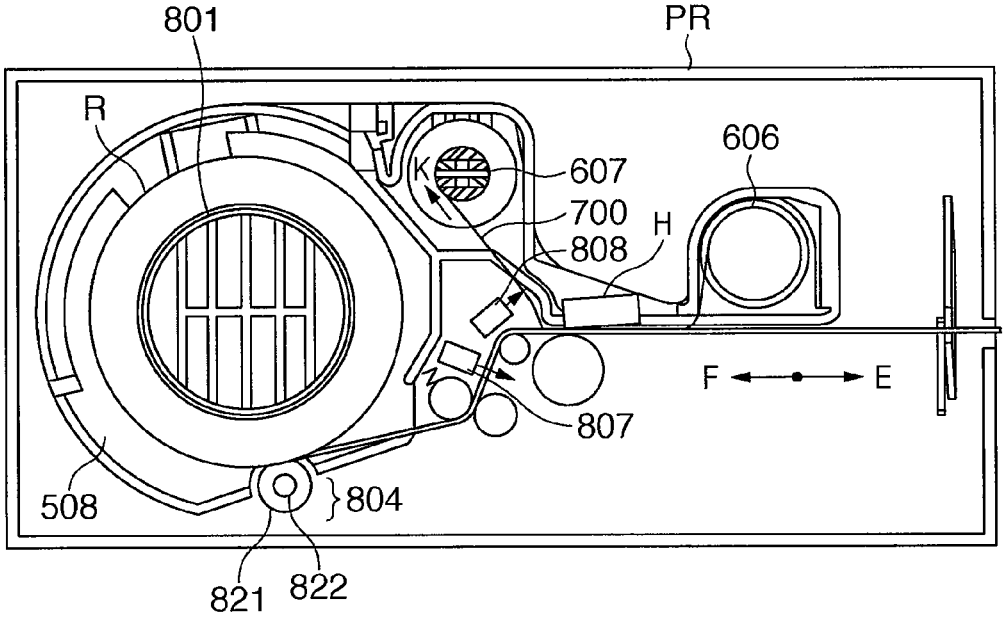

FIGS. 19A and 19B are sectional views of the printer according to this embodiment. FIG. 19A is a sectional view of a roll paper shaft pressing portion. The rotating shafts 803 integrally formed with the roll paper shaft 800 each are urged, toward a feed roller 804 together with the roll paper R, by the pressing lever 509 urged in the diameter expanding direction by an urging spring 812 between the inner surface of the cover portion 501 and the pressing lever 509. The feed roller 804 integrally includes a large-diameter roller portion 821 formed from an elastic member such as rubber and a small-diameter shaft portion 822 made of a metal. The feed roller 804 generates a driving force for feeding the roll paper R from the cassette main body 500 into the printer or rewinding the roll paper. When the user loads the cassette main body 500 into the printer and starts printing operation, the feed roller 804 moves to the position shown in FIG. 19A where it can clamp the roll paper R together with the roll paper shaft 800. In contrast, when the printing operation is complete, the feed roller 804 retreats to the position where it does not clamp the roll paper R together with the roll paper shaft 800. Reference numeral 805 denotes a grip roller having minute needle-like projections on the outer surface; 806, a pinch roller which is rotatably retained in the printer at a position opposite to the grip roller 805 so as to generate an urging force toward the grip roller side; and 807, a paper sensor such as a photoreflector for detecting the above end detection mark provided at a position spaced apart from the leading end of roll paper by a predetermined length or provided on the surface of roll paper at a position spaced apart from the leading end of roll paper by the predetermined length. The paper sensor 807 is placed in the widthwise direction of roll paper so as to detect the area of the end detection mark on the conveyed roll paper. Reference numeral 809 denotes a decurl roller for eliminating the tendency to curl of the roll paper R by twisting it in reverse; 810, a platen roller which is pivotally provided at a position opposite to the thermal head H and has an elastic roller made of rubber or the like on the outermost circumference; 811, a cutter for cutting the roll paper R in a predetermined length; and 808, a ribbon position sensor as an optical detection means for detecting the black bar 701 or ribbon head black bars 706 provided on the ink ribbon 700.

FIG. 19B is a sectional view of a portion near the middle portion in the widthwise direction of roll paper. There is a slight gap between the hollow portion of the roll paper R and the large-diameter portion 801 of the roll paper shaft 800. This is because, if the hollow portion of the roll paper R and the large-diameter portion 801 of the roll paper shaft 800 are in the press fit tolerance, when the user inserts the roll paper shaft 800 into the hollow portion of the roll paper R, he/she pushes out the roll paper in the axial direction in the form of a telescope. When the feed roller 804 moves to a predetermined height position in FIG. 19A at the start of printing, the roll paper shaft 800 always urges the large-diameter portion 801 of the roll paper shaft 800 against the inner surface of the hollow portion of the roll paper R with the force of the urging spring 812. The surface of the roll paper is always urged by the surface of the large-diameter roller portion 821 which is the large-diameter portion of the feed roller 804.

As shown in FIG. 19B, the thermal head H is lowered to a position where it can press the roll paper R against the platen roller 810 during printing. In other periods, the thermal head H is raised to the retreat position where it does not press the roll paper R against the platen roller 810.

At the time of printing, first of all, the thermal head H is at the retreat position, and the feed roller 804 and the grip roller 805 convey the roll paper R in a direction E in FIG. 19B to the position where the heating position of the thermal head H coincides with the printing start position of the roll paper R. More specifically, after the paper sensor 807 detects the leading end of the roll paper R, the printer conveys the roll paper by a predetermined length. While the printer conveys the roll paper R to the printing start position after the paper sensor 807 detects the leading end of the roll paper, the paper sensor 807 detects the end detection mark on the roll paper R. When the paper sensor 807 detects the end detection mark before the printer conveys the roll paper by the predetermined length, the printer stops conveying the roll paper R in the direction E in FIG. 19B, and conveys it in a direction F in FIG. 19B to rewind the roll paper R into the roll paper storage portion.

Secondly, when the printer conveys the roll paper to the printing start position, the printer drives the take-up bobbin 607 to take up the ink ribbon 700 in a direction K in FIG. 19B. Upon detecting the ribbon head black bars 706, the printer stops taking up the ribbon.

Thirdly, the thermal head H moves downward to a position to nip the roll paper R on the platen roller 810, and the feed roller 804 and the grip roller 805 convey the roll paper R in the direction F in FIG. 19B. At the same time, the printer transfers Y (yellow color) ink onto the printing surface of the roll paper R by heating the thermal head H while making the take-up bobbin 607 take up the ink ribbon 700 in the direction K in FIG. 19B. When completing printing by a desired length, the printer makes the thermal head H retreat, peels off the ink ribbon 700 and the roll paper R, conveys the roll paper R and the ink ribbon 700 by a predetermined length, and stops.

Fourthly, the printer conveys the roll paper R until the heating position of the thermal head H coincides with the printing start position of the roll paper R again.

Fifthly, the printer repeats printing with the M ink (magenta color) 703, C ink (cyan color) 704, and OC ink (overcoat layer) 705 in the same manner as described above. Upon completing printing with the four colors, the printer drives the feed roller 804 and the grip roller 805 to convey the leading end of the roll paper to a predetermined cutting position in the direction E in FIG. 19B and convey it outside the apparatus from the cutter 811, stops the conveyance, and causes the cutter 811 to cut a print portion from the roll paper R.

Sixthly, upon cutting the roll paper, the printer causes the feed roller 804 and the grip roller 805 to convey the leading end of the roll paper by a predetermined length in the direction E in FIG. 19B, then conveys it in the direction F in FIG. 19B, and rewinds the roll paper R into the roll paper storage portion 508 of the cassette main body 500. More specifically, after the paper sensor 807 detects the leading end of the roll paper while the roll paper is rewound and conveyed, the printer further rewinds and conveys the roll paper by a predetermined length.

As described above, in order to achieve a reduction in apparatus size, a printer PR of this embodiment is configured to be able to repeatedly feed and take up the roll paper R, and hence repeatedly feeds and takes up roll paper a plurality of number of times to form one color print. During this repetitive operation, the roll paper shaft 800 rotates and slides in the hollow portion of the roll paper R, and the large-diameter portion 801 presses the inner surface of the hollow portion of the roll paper R.

Figure 20A:
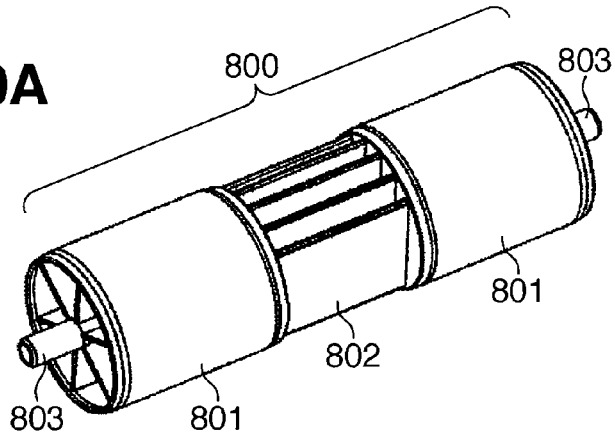
FIGS. 20A to 20C are views showing a roll paper retaining portion in this embodiment in detail.
Figure 20B:
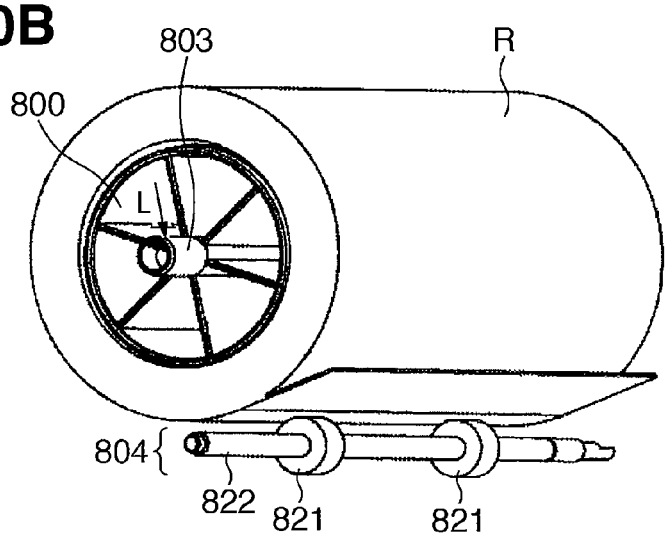
Figure 20C:
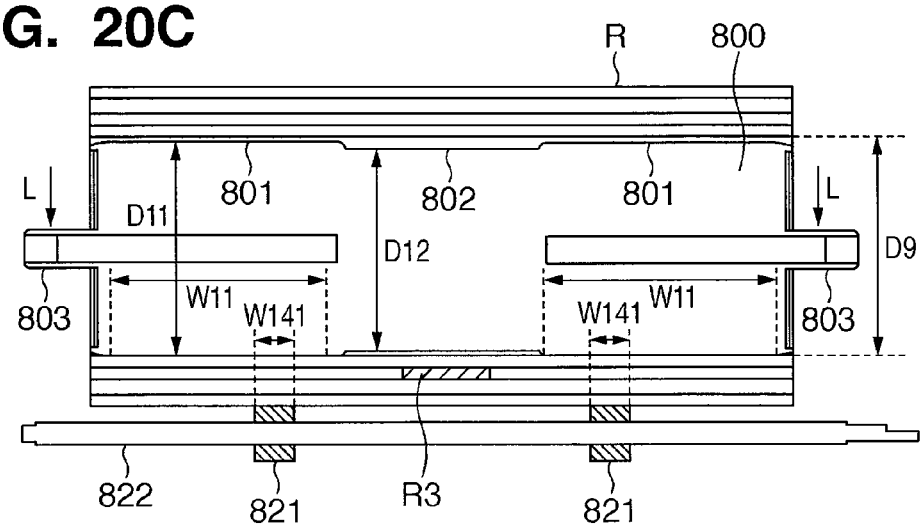

FIGS. 20A to 20C show the details of a roll paper retaining portion in this embodiment. Like FIG. 18, FIG. 20A is a perspective view of the roll paper shaft. FIG. 20B is a perspective view showing the positional relationship between the roll paper shaft, the roll paper, and the feed roller at the time of printing. When the roll paper shaft 800 is inserted in the hollow portion of the roll paper R, the rotating shafts 803 are pressed by a pressing force L of the pressing levers 509 (not shown), and the large-diameter portion 801 is inscribed in the inner surface of the hollow portion of the roll paper R and presses it in the direction of the rotation center of the feed roller 804.

FIG. 20C is a sectional view having the roll paper shaft center and the feed roller shaft center. An outer diameter D11 of the large-diameter portion 801 is larger than an outer diameter D12 of the small-diameter portion 802 (D11>D12). An inner diameter D9 of the hollow portion of the roll paper R is slightly larger than the outer diameter D11 to prevent the roll paper from deforming in the form of a telescope when the inner surface of the hollow portion is pressed in the axial direction at the time of insertion of the shaft (D9>D11).

In printing operation, since the maximum outer diameter D11 of the roll paper shaft 800 is slightly different from the inner diameter D9 of the hollow portion of the roll paper, they rotate with a slight difference in the number of rotations. That is, the large-diameter portion 801 of the roll paper shaft 800 slides on the inner surface of the hollow portion of the roll paper R during printing, whereas the large-diameter portion 801 and the inner surface of the hollow portion of the roll paper R are in tight contact with each other and rotate in the same direction while changing their positions during printing.

In the above arrangement, the area W11 where the large-diameter portion 801 of the roll paper shaft 800 is in contact with the inner surface of the coreless portion of the roll paper R overlaps the area W141 where the roller portion 821 as the outermost circumferential portion of the feed roller 804 is in contact with the outermost circumferential portion of the roll paper. In this manner, it is possible to allow the pressing force L of the pressing levers added to the roll paper shaft 800 to efficiently act on the roll paper by interposing the stacked paper portion of the roll paper between the large-diameter portion 801 of the roll paper shaft 800 and the feed roller 804 so as to uniform the thickness of the stacked paper portion of the roll paper.

In addition, the hole R3 as the end detection mark of the roll paper is placed at the position where it is opposite to the small-diameter portion 802 which does not make contact with the inner surface of the hollow portion of the roll paper R, avoiding positions immediately below the areas W11 and W141 where relatively high pressures are applied. Although the hole R3 has been described with reference to FIGS. 20A to 20C, the same applies to an engraved mark accompanied by a concave/convex pattern on the surface of the roll paper or the end detection mark R4 formed by printing, which have been described with reference to FIGS. 16A to 16C.

Placing the end detection mark R3 or R4 accompanied by a concave/convex portion on the surface of the roll paper while avoiding the area W11 described above can retain the roll paper in the printer while inhibiting any high pressure from acting on the convex/concave portion on the surface of the roll paper. Even if an end detection mark is wound immediately near the inner surface of the hollow portion of the roll paper R for the purpose of end detection, in particular, placing the mark on a portion other than a portion immediately below the area W11 will increase the effect of inhibiting any pressure from acting on the end detection mark R3 or R4 accompanied by a concave/convex pattern on the surface of the roll paper.

In addition, the hollow portion of the roll paper R is formed into a cylindrical shape by making one turn of the roll paper fixed with a double-sided tape, and hence is weak. That is, during printing, a space is formed between the inner surface of the hollow portion of the roll paper R and the small-diameter portion 802, and an adequate clearance is formed on the inner surface of the hollow portion of the roll paper R. Therefore, no pressure acts on the large-diameter portions 801. This can reduce the chance of transferring a convex/concave shape of the end detection mark R3 or R4 itself, which is accompanied by a convex/concave pattern on the surface of the roll paper R, or transferring printed ink at the time of rewinding onto a portion of the roll paper R which is wound so as to overlap a portion near the end detection mark.

In order to make the large-diameter portion 801 of the roll paper shaft 800 as a rigid body have a surface without any irregularities, the large-diameter portions 801 are thinned out from the axial end faces instead of the outermost circumferential portions. This makes the large-diameter portions 801, on which pressing forces act, free from irregularity, and hence prevents the roll paper shaft itself from transferring a convex/concave shape onto the inner surface of the hollow portion of the roll paper R.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-172782, filed Jul. 30, 2010 which is hereby incorporated by reference herein in its entirety.

What is claimed is:

1. A sheet storage cassette which contains a print sheet in roll form wound into a hollow cylindrical shape and is attached to a printing apparatus, the cassette comprising:

a sheet retaining shaft which retains the print sheet in roll form by being made to extend through a hollow portion of the print sheet and making an urging member urge an inner surface of the hollow portion in a diameter expanding direction; and a support portion which rotatably supports said sheet retaining shaft, wherein the urging member protrudes from a maximum outer diameter of said sheet retaining shaft while the print sheet is not attached to said sheet retaining shaft, and urges the inner surface of the hollow portion of the print sheet in the diameter expanding direction while the print sheet is attached to said sheet retaining shaft, and a rib portion which is provided at said sheet retaining shaft and continuously extends in a rotational direction and contacts a pickup guide, which picks up a leading end of a print sheet which is rotated by a roller portion of said printing apparatus, when the urging member rotates, wherein the rib portion is provided to prevent the pickup guide from interfering with the urging member which rotates together with said sheet retaining shaft.

2. The cassette according to claim 1, wherein said sheet retaining shaft comprises cylindrical portions having a maximum outer diameter of said sheet retaining shaft and smooth surfaces which slidably make contact with the inner surface of the hollow portion of the print sheet, and a small-diameter portion having a smaller diameter than the cylindrical portions protruding from two end portions of said sheet retaining shaft in an axial direction, and is supported with the small-diameter portion being pressed while the print sheet is attached, and an urging force of the urging member is smaller than pressing forces on the two end portions of said sheet retaining shaft.

3. The cassette according to claim 2, wherein the urging member is formed between the cylindrical portions provided on two sides of said sheet retaining shaft.

4. The cassette according to claim 1, wherein the pressing surface of the urging member has a shape or a curved surface shape which is inclined in a rotational direction of said sheet retaining shaft and an axial direction of said sheet retaining shaft.

5. The cassette according to claim 1, further comprising a restriction member which restricts a deformation amount of the urging member when the urging member is urged in the diameter expanding direction.

6. The cassette according to claim 5, wherein said restriction member is formed into a disc shaped rib portion provided on said sheet retaining shaft, and the disc shaped rib portion restricts a distal end of the pickup guide not to approach the urging member by not less than a predetermined distance by contacting part of the pickup guide.

7. The cassette according to claim 5, wherein a rib is formed in a space below the urging member to inhibit a user from displacing the urging member upward.

8. The cassette according to claim 1, wherein the pickup guide is provided on the sheet storage cassette or the printing apparatus.

9. The cassette according to claim 1, wherein the urging member urges the inner surface of the hollow portion of the print sheet in the diameter expanding direction by elastically deforming in the diameter expanding direction.

10. A printing apparatus which performs printing by transferring ink onto a print sheet using a thermal head, the apparatus comprising:

a sheet storage cassette defined in claim 1; and convey means for conveying a print sheet from said sheet storage cassette to the thermal head.

* * * * *